US010658753B2

(12) United States Patent
Tseng et al.

(10) Patent No.: US 10,658,753 B2
(45) Date of Patent: May 19, 2020

(54) ANTENNA STRUCTURE

(71) Applicant: WISTRON NEWEB CORPORATION, Hsinchu (TW)

(72) Inventors: Shih-Hsien Tseng, Hsinchu (TW); Chih-Ming Wang, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 121 days.

(21) Appl. No.: 15/869,959

(22) Filed: Jan. 12, 2018

(65) Prior Publication Data

US 2019/0044232 A1 Feb. 7, 2019

(30) Foreign Application Priority Data

Aug. 2, 2017 (TW) ..... 106126080 A

(51) Int. Cl.
*H01Q 5/342* (2015.01)
*H01Q 1/24* (2006.01)
(Continued)

(52) U.S. Cl.
CPC ..... *H01Q 5/342* (2015.01); *H01Q 1/243* (2013.01); *H01Q 1/245* (2013.01); *H01Q 5/328* (2015.01);
(Continued)

(58) Field of Classification Search
CPC ..... H01Q 1/243; H01Q 1/38; H01Q 1/48; H01Q 1/2266; H01Q 1/245; H01Q 5/378;
(Continued)

(56) References Cited

U.S. PATENT DOCUMENTS 8,432,332 B2 4/2013 Tsai et al.
8,466,839 B2 6/2013 Schlub et al.
(Continued)

FOREIGN PATENT DOCUMENTS

CN 103259076 A 8/2013
CN 103516839 A 1/2014
CN 206076499 U 4/2017

OTHER PUBLICATIONS

Christophe Caloz, et al., "Microwave Circuits Based on Negative Refractive Index Material Structures", pp. 105-109, 33rd European Microwave Conference, Dec. 31, 2003.

*Primary Examiner* — Robert Karacsony
(74) *Attorney, Agent, or Firm* — Li & Cai Intellectual Property (USA) Office

(57) ABSTRACT

The instant disclosure provides an antenna structure including a substrate, a first radiation element, a second radiation element, a coupling element, a grounding element, and a feeding element. The first radiation element is disposed on the substrate, including a first radiation portion, a second radiation portion, and a feeding portion connected between the first radiation portion and the second radiation portion. The second radiation element is disposed on the substrate, including a third radiation portion and a coupling portion connected with the third radiation portion. A gap is formed between the first radiation portion and the third radiation portion. The coupling element is disposed on the substrate. The coupling element is separated from the coupling portion and coupling to the coupling portion. The grounding element is coupled with the coupling element. The feeding element is coupled with the feeding portion and the grounding element.

20 Claims, 19 Drawing Sheets

(51) Int. Cl.

| | |
|---|---|
| ***H01Q 5/328*** | (2015.01) |
| ***H01Q 9/42*** | (2006.01) |
| ***H01Q 5/378*** | (2015.01) |
| ***H01Q 1/38*** | (2006.01) |

(52) U.S. Cl.
CPC ..... *H01Q 5/378* (2015.01); *H01Q 9/42* (2013.01); *H01Q 1/38* (2013.01)

(58) Field of Classification Search
CPC ..... H01Q 5/371; H01Q 5/328; H01Q 5/392; H01Q 5/385; H01Q 9/42; H01Q 9/0421
See application file for complete search history.

(56) References Cited

U.S. PATENT DOCUMENTS

| | | | | |
|---|---|---|---|---|
| 8,577,289 | B2 | 11/2013 | Schlub et al. | |
| 8,779,989 | B2 | 7/2014 | Huang et al. | |
| 10,056,696 | B2 | 8/2018 | Tseng et al. | |
| 2011/0012793 | A1 | 1/2011 | Amm et al. | |
| 2011/0037665 | A1* | 2/2011 | Ahn ..... | H01Q 9/42 343/702 |
| 2013/0335258 | A1 | 12/2013 | Chung et al. | |
| 2014/0361948 | A1 | 12/2014 | Tanaka et al. | |
| 2015/0236422 | A1* | 8/2015 | You ..... | H01Q 7/00 343/729 |

* cited by examiner

ANTENNA STRUCTURE

BACKGROUND OF THE INVENTION

1. Field of the Invention

The present disclosure relates to an antenna structure; more particularly, to an antenna structure with a coupling structure.

2. Description of Related Art

The increasing usage rate of portable devices (e.g., smart phone, tablet and laptop) has resulted in more and more attention being drawn to wireless technologies in portable devices in relevant industries. The quality of wireless communication depends on the antenna efficiency, thus making the improvement of radiation efficiencies of the antenna and the ease with which frequencies can be adjusted critical factors.

Since the electromagnetic wave radiated by antennas affects human bodies, the International Commission on Non-Ionizing Radiation Protection (ICNIRP) has recommended that the specific absorption rate (SAR) for biological bodies should not exceed 2.0 W/Kg, while the Federal Communications Commission (FCC) of the United States also recommended that the SAR value should not exceed 1.6 W/Kg. However, most of the current technologies focusing on increasing antenna efficiencies elevate the SAR value.

In recent years, products that combine both a laptop and a tablet have be widely developed, such as hybrid laptops or 2-in-1 laptops, which implies that laptops can be operated under regular mode or tablet mode. However, when the conventional antenna structure operates under tablet mode, the SAR value thereof is unable to meet regulatory requirements. According to U.S. Pat. No. 8,577,289, titled "Antenna with integrated proximity sensor for proximity-based radio-frequency power control," a technology of adjusting the transmission power of an antenna based on the signal detected on a human body is disclosed. In said patent, two grounded capacitors disposed between a feeding end and a transceiver are used, so as to allow an antenna to have sensing capabilities. However, the two grounded capacitors would downgrade the antenna characteristics and sensing distance.

SUMMARY OF THE INVENTION

Therefore, an antenna system and structure is provided to address the deficiencies in the conventional technology. The antenna system and structure provided in the present disclosure not only increases antenna performance, but also prevents SAR values from reaching overly high.

An antenna structure as provided in the present disclosure, in order to solve the above addressed problems, includes a substrate, a first radiation element, a second radiation element, a coupling element, a grounding element, and a feeding element. The first radiation element is disposed on the substrate, including a first radiation portion, a second radiation portion, and a feeding portion connected between the first radiation portion and the second radiation portion. The second radiation element is disposed on the substrate, including a third radiation portion and a coupling portion connected with the third radiation portion. A gap is formed between the first radiation portion and the third radiation portion. The coupling element is disposed on the substrate. The coupling element is separated from the coupling portion and coupling to the coupling portion. The grounding element is coupled with the coupling element. The feeding element is coupled between the feeding portion and the grounding element.

An antenna structure as provided in the present disclosure, in order to solve the above addressed problems, includes a substrate, a first radiation element disposed on the substrate, including a first radiation portion, a second radiation portion, and a feeding portion connected between the first radiation portion and the second radiation portion. A second radiation element is disposed on the substrate, including a third radiation portion, in which a gap is formed between the third radiation portion and the first radiation portion. A system in package (SIP) component disposed on the substrate, having a multi-layer metal layer, a first metal layer of the multi-layer metal layer serving as a coupling portion and a second metal layer of the multi-layer metal layer serving as a coupling element. The SIP component has a sensing circuit disposed on a third metal layer of the multi-layer metal layer. The coupling portion connects with third radiation portion, and the coupling element and the coupling portion are separate from and coupling to each other. The sensing circuit includes a proximity sensing circuit and an inductor connecting with the coupling portion. The coupling portion serves as a sensing electrode for the proximity sensor circuit to measure a capacitance. A grounding element is coupled with the coupling element, and the sensing circuit electrically connects with the grounding element through the coupling element. A feeding element is coupled between the feeding portion and the grounding element.

One of the effects of the antenna structure as provided in the present disclosure is that, not only is the antenna performance increased, but the incident of a user being exposed to an overly high SAR value when approaching an antenna is also prevented from happening.

In order to further the understanding of the present disclosure, the following embodiments are provided along with illustrations to facilitate the disclosure of the present disclosure.

DETAILED DESCRIPTION OF THE PREFERRED EMBODIMENTS

The aforementioned illustrations and following detailed description are exemplary for the purpose of further explaining the scope of the present disclosure. Other objectives and advantages related to the present disclosure will be illustrated in the following description and appended drawings.

In the following description, the term "coupling" refers to the energy that is transmitted in a separate manner, while "coupled" refers to connected directly or indirectly.

The First Embodiment

Figure 1:
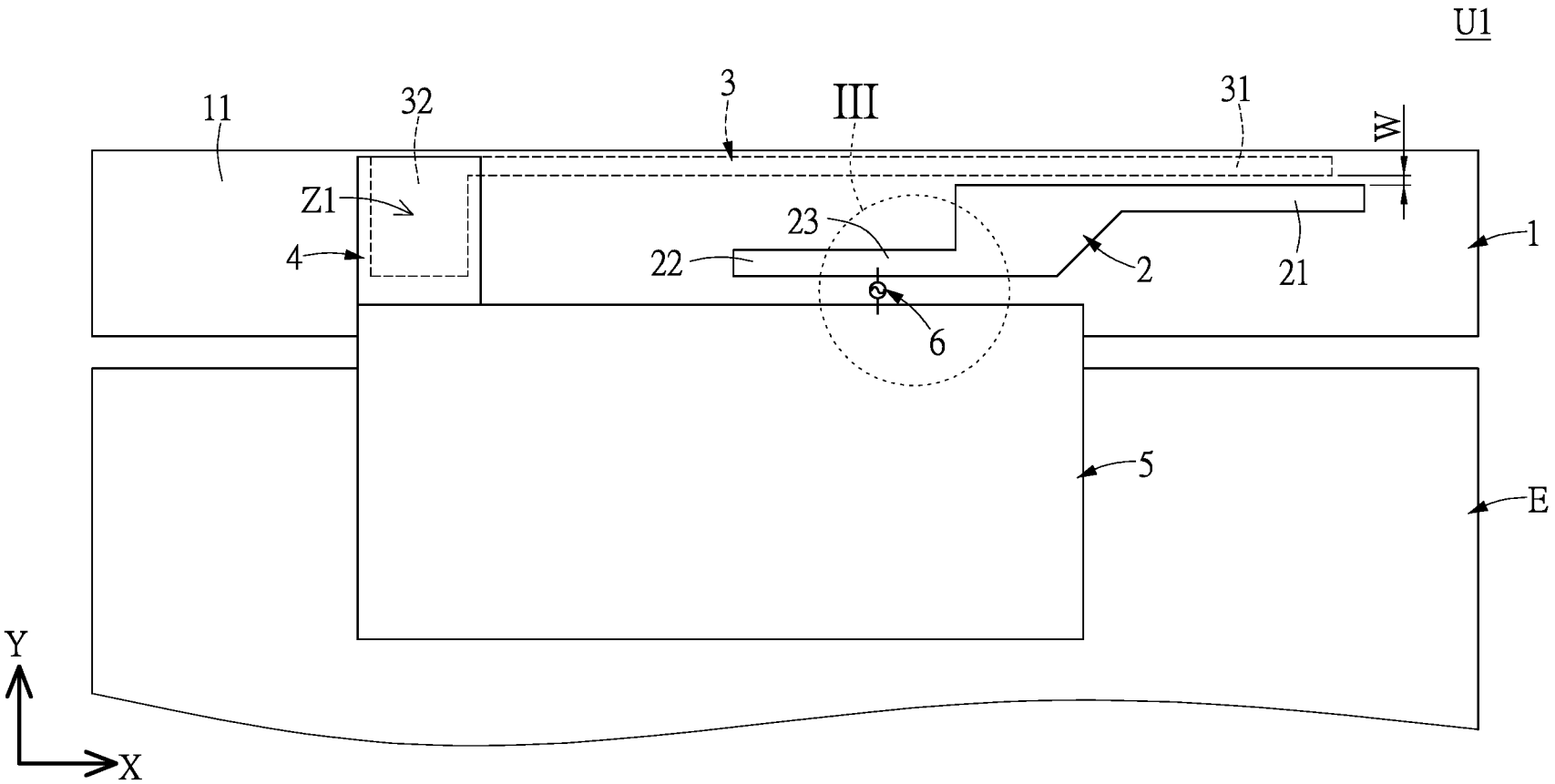
FIG. 1 is a schematic top view of an antenna structure according to a first embodiment of the present disclosure.
Figure 2:
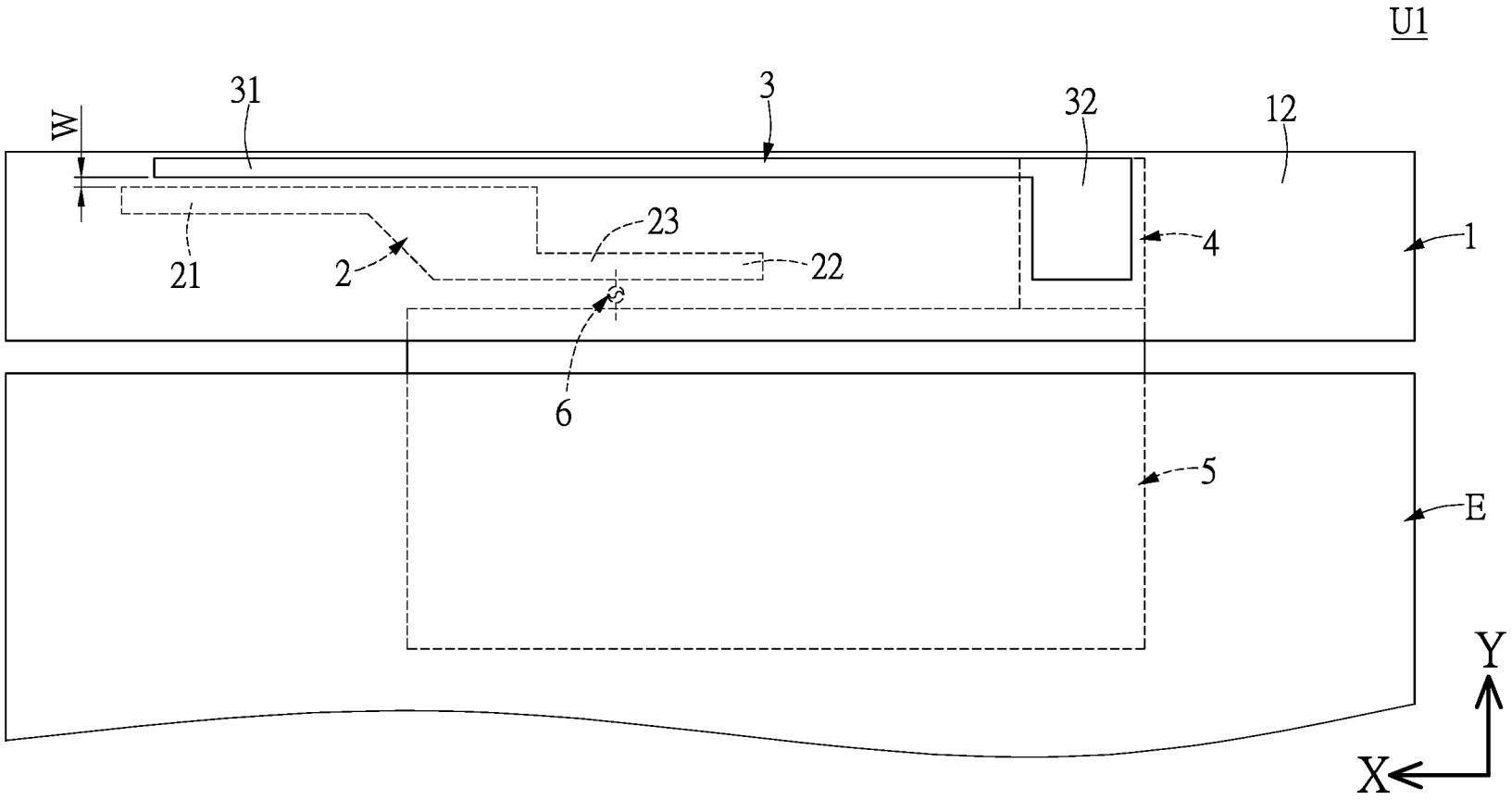
FIG. 2 is a schematic bottom view of the antenna structure according to the first embodiment of the present disclosure.

Reference is first made to FIGS. 1 and 2, where FIG. 1 is a schematic top view of an antenna structure according to a first embodiment of the present disclosure and FIG. 2 is a schematic bottom view of the antenna structure according to the first embodiment of the present disclosure. In the first embodiment, an antenna structure U1 is provided. The antenna structure U1 includes a substrate 1, a first radiation element 2, a second radiation element 3, a coupling element 4, a grounding element 5, and a feeding element 6. The first radiation element 1, the second radiation element 3 and the coupling element 4 can be disposed on the substrate 1. The grounding element 5 can be coupled with the coupling element 4 and be separate from the first radiation element 2 and the second radiation element 3. Moreover, the feeding element 6 can be coupled between a feeding portion 23 of the first radiation element 2 and the grounding element 5, and the feeding element 6 is configured to feed in a signal.

Figure 3:
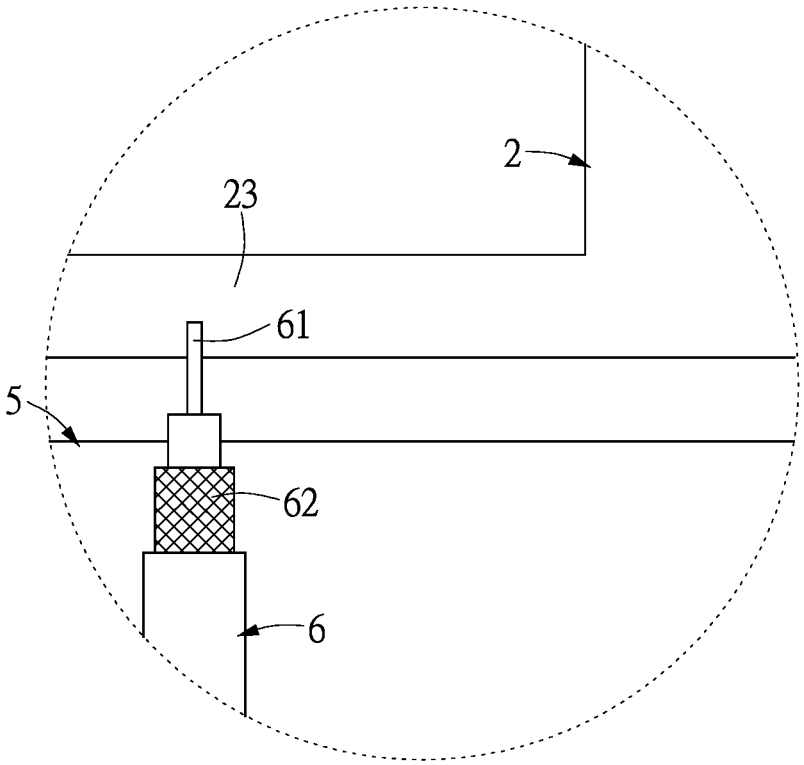
FIG. 3 is a fragmentary enlarged view of section III in FIG. 1.

It should be noted that the materials of the substrate 1, the first radiation element 2, the second radiation element 3, the coupling element 4, the grounding element 5 and the feeding element 6 can be any conductive materials, and these elements can be manufactured by any methods, and details thereof will be omitted for the sake of brevity. For example, the first radiation element 2, the second radiation element 3 and the coupling element may be, but not limited to, a metal sheet, a metal wire, or other electric conductor. Moreover, the substrate 1 can be a printed circuit board (PCB). Furthermore, the feeding element 6 can be, but not limited to, a coaxial cable. It should be noted the above examples are for exemplary purposes only, and should not be taken as limiting the scope of the present disclosure. Referring collectively to FIG. 3, the feeding element 6 as shown in FIG. 3 is a coaxial cable having a feeding end 61 and a ground end 62. The feeding end 61 electrically connects with the feeding portion 23 of the first radiation element 2, and the grounding end 62 electrically connects with the grounding element 5. In order to facilitate easy understanding of the figures, alternative element labels are used for the coaxial table structure in FIG. 3 in other figures.

Referring back to FIGS. 1 and 2, the substrate 1 includes a first surface 11 (i.e., an upper surface) and a second surface 12 (i.e., a bottom surface) opposite to the first surface 11. In the first embodiment, the first radiation element 2 and the coupling element 4 are disposed on the first surface 11 of the substrate 1, and the second radiation element 3 is disposed on the second surface 12 of the substrate 1. Therefore, the coupling element 4 can be separate from and coupling to a coupling portion 32 of the second radiation element 3. However, in other embodiments, the first radiation element 2, the second radiation element 3 and the coupling element 4 can be disposed on the same surface (i.e., the first surface 11), or in another embodiment, the coupling element 4 can be disposed on the first surface 11 and the first radiation element 2 and the second radiation element 3 can be disposed on the second surface, so as to make the coupling element 4, the first radiation element 2 and the second radiation element 3, but not limited to being, disposed on two opposite sides of the substrate 1. Furthermore, the grounding end 62 of the feeding element 6 can electrically connect with one of the sides of the grounding element 5, and the other side of the grounding element 5 can electrically connect with a metal conductor E, where the metal conductor E is separated from the substrate 1.

Referring to FIGS. 1 and 2, the first radiation element 2 includes a first radiation portion 21, a second radiation portion 22, and a feeding portion 23 connected between the first radiation portion 21 and the second radiation portion 22. The second radiation element 3 includes a third radiation portion 31 and a coupling portion 32 connected with the third radiation portion 31. Moreover, a gap W is formed between the third radiation portion 31 and the first radiation portion 21. That is to say, the third radiation portion 31 of the second radiation element 3 and the first radiation portion 21 have the gap W along a vertical projection direction of the first surface 11.

To be more precise, the coupling element 4 and the coupling portion 32 of the second radiation element 3 are separated from and coupling to each other. According to the first embodiment, the coupling element 4 is disposed on the first surface 11, the coupling portion 32 of the second radiation element 3 is disposed on the second surface 12, and the coupling element 4 and the coupling portion 32 at least partially overlap with each other along a vertical projection direction of the first surface 11. The overlapping area of the coupling element 4 and the coupling portion 32 is defined as a first coupling area Z1. It should be noted that, in order to c facilitate easy understanding of the figures, the area of the coupling portion 32 is shown to be smaller than that of the coupling element 4. However, in other embodiments, the area of the coupling portion 32 can be larger than that of the coupling element 4. Furthermore, the area of the first coupling area Z1 can be adjusted by adjusting the relative positions of the coupling portion 32 and coupling element 4, or by adjusting the areas of the coupling portion 32 and coupling element 4.

Referring to FIGS. 1 and 2, when the antenna structure U1 is placed on the X-Y plane, the first radiation portion 21 extends along a first direction (positive x direction) relative to the feeding portion 23, and the second radiation portion 22 extends along a second direction (negative x direction) relative to the feeding portion 23, where the first direction (positive x direction) and the second direction are distinct (negative x direction). For example, in the embodiments shown in FIGS. 1 and 2, the first direction (positive x direction) and the second direction are distinct (negative x direction) and are opposite with each other. In other words, the first radiation portion 21 and the second radiation portion 22 respectively extend from two opposite sides of the feeding portion 23. Moreover, the third radiation portion 31 extends along the first direction (positive x direction) relative to the coupling portion 32, so as to allow the third radiation portion 31 of the second radiation element 2 and the first radiation portion 21 to have the gap W along a vertical projection direction of the first surface 11.

It should be noted that, according to the present embodiment, a first operating frequency band is generated by the first radiation portion 21, a second operating frequency band is generated by the second radiation portion 22, and a third operating frequency band is generated by a resonation between the third radiation portion 31 and the first radiation portion 21. For example, the bandwidth (BW) of the first operating frequency band ranges from, but is not limited to, 1425 MHz to 2170 MHz, the BW of the second operating frequency band ranges from, but is not limited to, 2170 MHz to 2690 MHz, and the BW of the third operating frequency band ranges from, but is not limited to, 698 MHz to 960 MHz, so as to be suitable for different bands of Long Time Evolution (LTE). In other words, the BW of the operating frequency provided by the first radiation element 2 falls between 1425 MHz and 2690 MHz, and the BWs of the operating frequency provided by the first radiation portion 21 of the first radiation element 2 and the third radiation portion 31 of the second radiation element 3 fall between 698 MHz and 960 MHz.

Referring to FIGS. 1 and 2, the bigger the area (the coupling level of the coupling element 4 and the coupling portion 32) of the first coupling area Z1 (the overlapping area of the coupling element's 4 projection on the X-Y plane and the coupling portion's 32 projection on the X-Y plane) between the coupling element 4 and the coupling portion 32 is, the better the impedance matching of the third operating frequency band (i.e., low operating frequency band) generated by the antenna structure U1, and the closer to a predetermined impedance value (e.g., 50 ohm) an impedance value that the center frequency of the third operating frequency band corresponds to is. However, when the first coupling area Z1 is greater than a predetermined value, the impedance value that the center frequency of the third operating frequency band corresponds to would stop changing. Moreover, when the area of the first coupling area Z1 between the coupling element 4 and the coupling portion 32 gets smaller, the impedance value that the center frequency of the third operating frequency band corresponds to would depart from the predetermined impedance.

The size of the gap W that the third radiation portion 31 and the first radiation portion 21 have along a vertical projection direction of the first surface 11 is proportional to the impedance matching effect of the first operating frequency band and second operating frequency band (i.e., the higher operating frequency band), and the size of the gap W that the third radiation portion 31 and the first radiation portion 21 have along a vertical projection direction of the first surface 11 is inversely proportional to the impedance matching effect of the third operating frequency band. That is to say, the smaller the gap W is, the better the impedance matching of the third operating frequency band of the antenna structure U1, but the worse the impedance matching of the first and second operating frequency bands are (the center frequencies of the first and second operating frequency band are departed from a predetermined impedance). Conversely, the bigger the gap W is, the worse the impedance matching of the third operating frequency band of the antenna structure U1, but the better the impedance matching of the first and second operating frequency bands are.

The Second Embodiment

Figure 4:
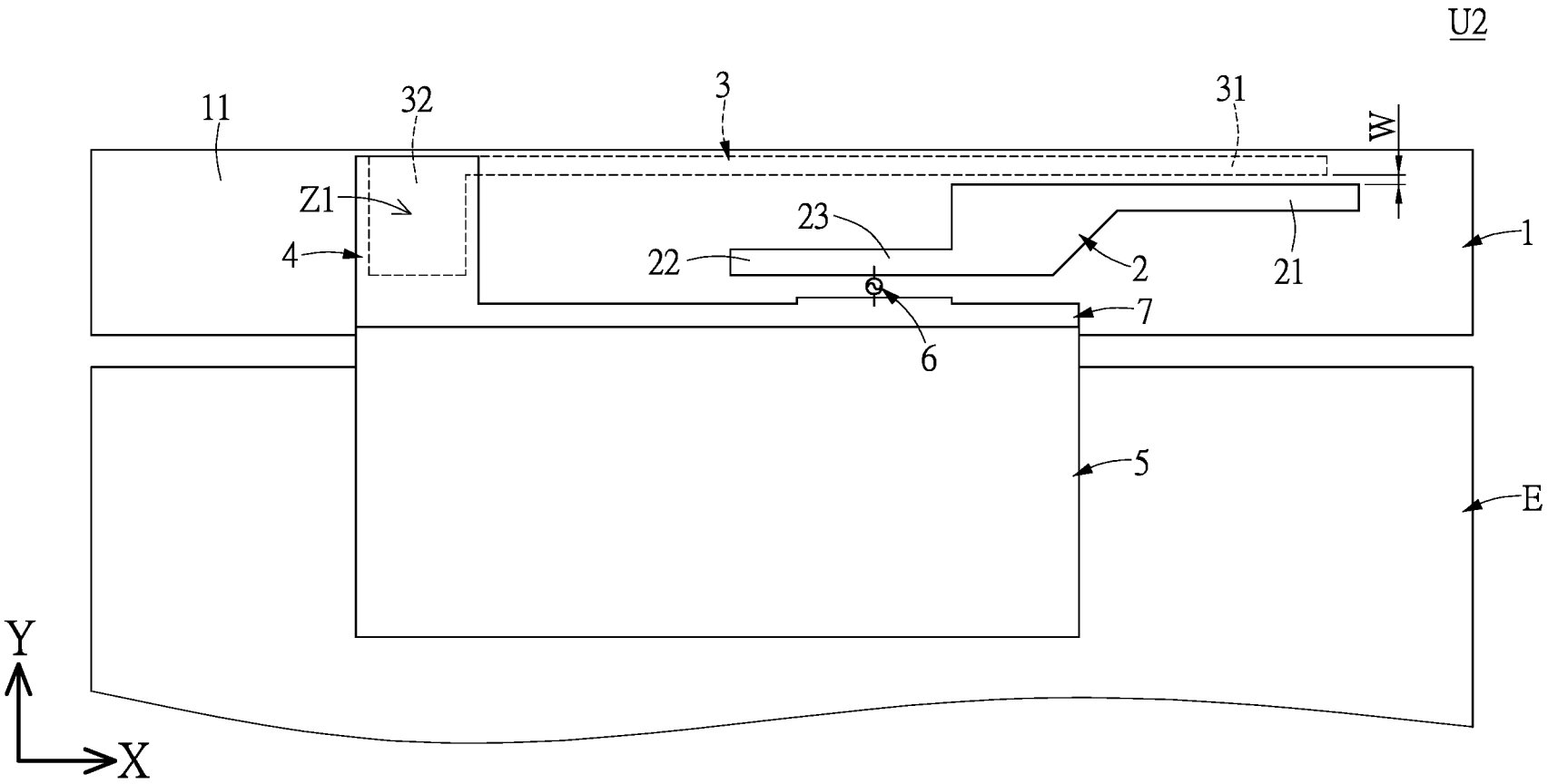
FIG. 4 is a schematic top view of the antenna structure according to a second embodiment of the present disclosure.

Reference is next made to FIG. 4, where FIG. 4 is a schematic top view of the antenna structure according to a second embodiment of the present disclosure. Comparing FIG. 1 and FIG. 4, it can be seen that one of the differences therebetween is that the antenna structure U2 as provided in the second embodiment further includes a bridging element 7. To be more specific, the bridging element 7 can be disposed on the first surface 11 of the substrate 1, the bridging element 7 can connect between the grounding element 5 and the coupling element 4 (or coupled with in between the grounding element 5 and the coupling element 4), and the bridging element 7 can connect between the grounding element 5 and the feeding element 6, so as to allow the feeding element 6 to be coupled with the grounding element 5 through the bridging element 7. In other words, the main body (not shown in the figure) of the coupling element 4 can be coupling to the coupling portion 32 of the second radiation element 3, and one of the ends of the coupling element 7 can connect with the bridging element 7, so as allowing the coupling element 4 to be coupled with the grounding element 5 through the bridging element 7. Moreover, the feeding end 61 of the feeding element 6 can be coupled with the feeding portion 23, and the grounding end 62 of the feeding element 6 can be coupled with the bridging element 7, so as allowing the feeding element 6 to be coupled with the grounding element 5 through the bridging element 7. It should be noted that other structural features or the frequency range of the operating frequency band is similar to that of the previous embodiment, thus relevant details are omitted for the sake of brevity.

Regarding to FIG. 4, the coupling element 4 and the bridging element 7 can be, but not limited to, integrally-formed. It should be noted that the purpose of disposing the bridging element 7 is for the grounding element 5 to be easily attached onto the substrate 1. Although the bridging element 7 is involved in the implementation of FIG. 4, however, the bridging element 7 is optional. Moreover, the material of the bridging element 7 can be, but not limited to, tin, and the material of the grounding element 5 can be, but not limited to, copper.

Figure 5:
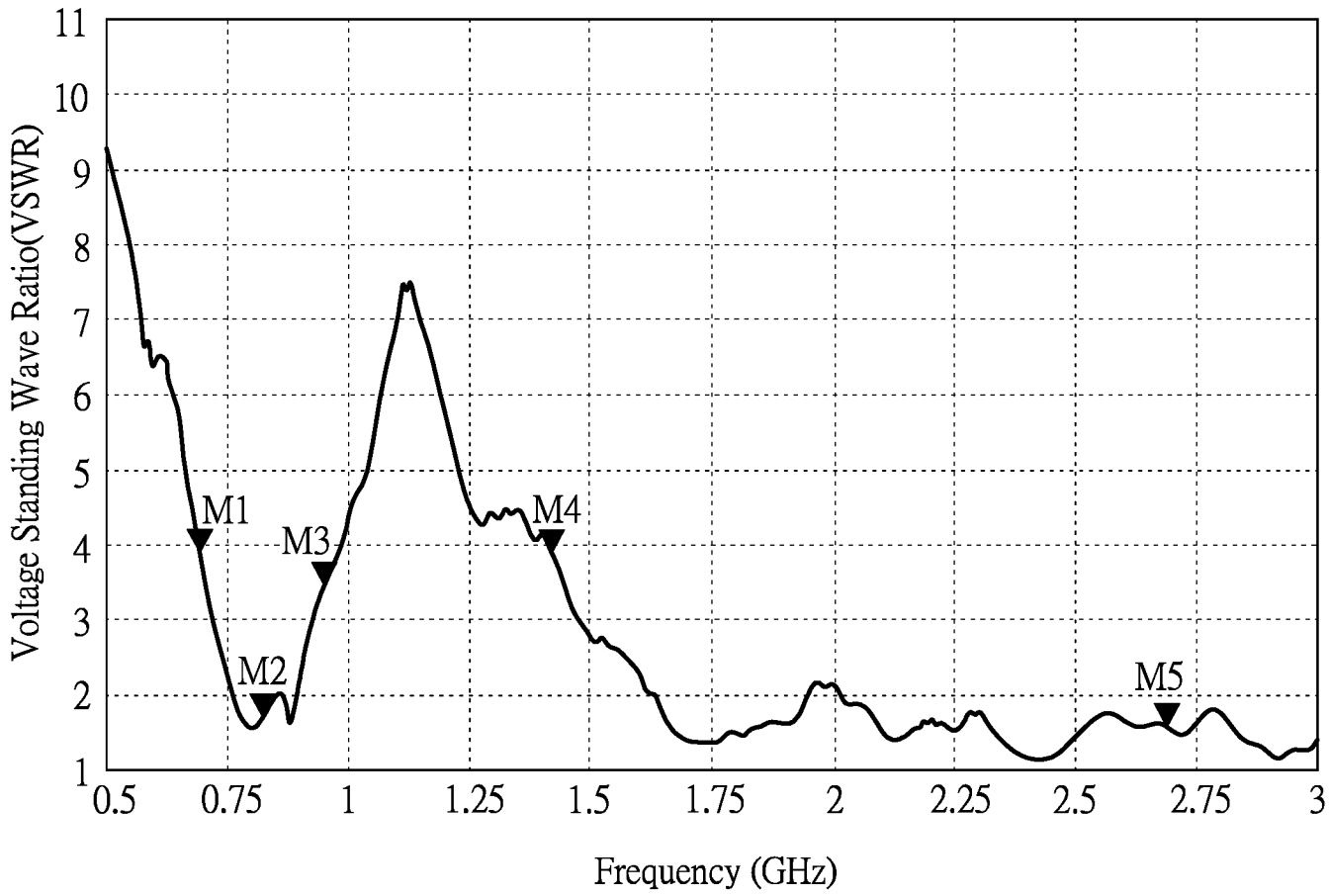
FIG. 5 is a schematic view illustrating a curve diagram of the voltage standing wave ratio (SWR) of the antenna structure according to the second embodiment of the present disclosure under different frequencies.

Reference is collectively made to FIG. 5 and Table 1 shown below, where FIG. 5 is a schematic view illustrating a curve diagram of the voltage standing wave ratio (SWR) of the antenna structure according to the second embodiment of the present disclosure under different frequencies.

TABLE 1

| Node | Frequency(MHz) | Voltage SWR |
|---|---|---|
| M1 | 698 | 3.93 |
| M2 | 824 | 1.68 |
| M3 | 960 | 3.46 |
| M4 | 1425 | 3.91 |
| M5 | 2690 | 1.57 |

The Third Embodiment

Figure 6:
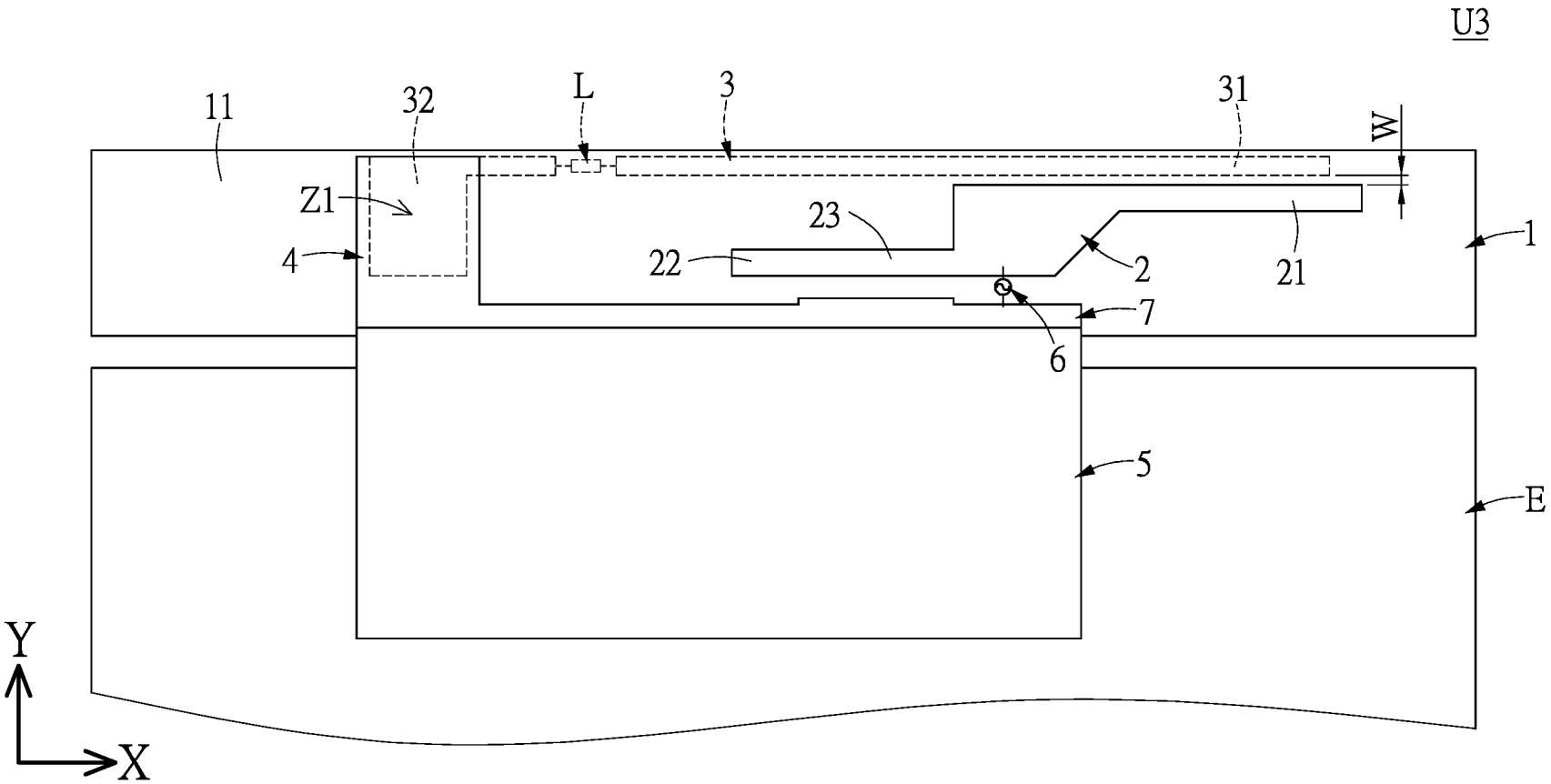
FIG. 6 is a schematic top view of the antenna structure according to a third embodiment of the present disclosure.

Reference is next made to FIG. 6, where FIG. 6 is a schematic top view of the antenna structure according to a third embodiment of the present disclosure. Comparing FIG. 6 and FIG. 4, it can be seen that one of the differences therebetween is that the antenna structure U3 as provided in the third embodiment further includes an inductor L disposed between the third radiation portion 31 and the coupling portion 32. Furthermore, the magnitude of the inductance can be adjusted by changing the inductor L, and the bandwidth and the center frequency of the operating frequency bands (the first, second and third operating frequency bands) can thereby be adjusted. Moreover, in other implementations, the feeding element 61 can be, but not limited to, disposed adjacent to the first radiation portion 21 of the first radiation element 2. It should be noted that other structural features or the frequency range of the operating frequency band is similar to that of the previous embodiment, thus relevant details are omitted for the sake of brevity.

The Fourth Embodiment

Figure 7:
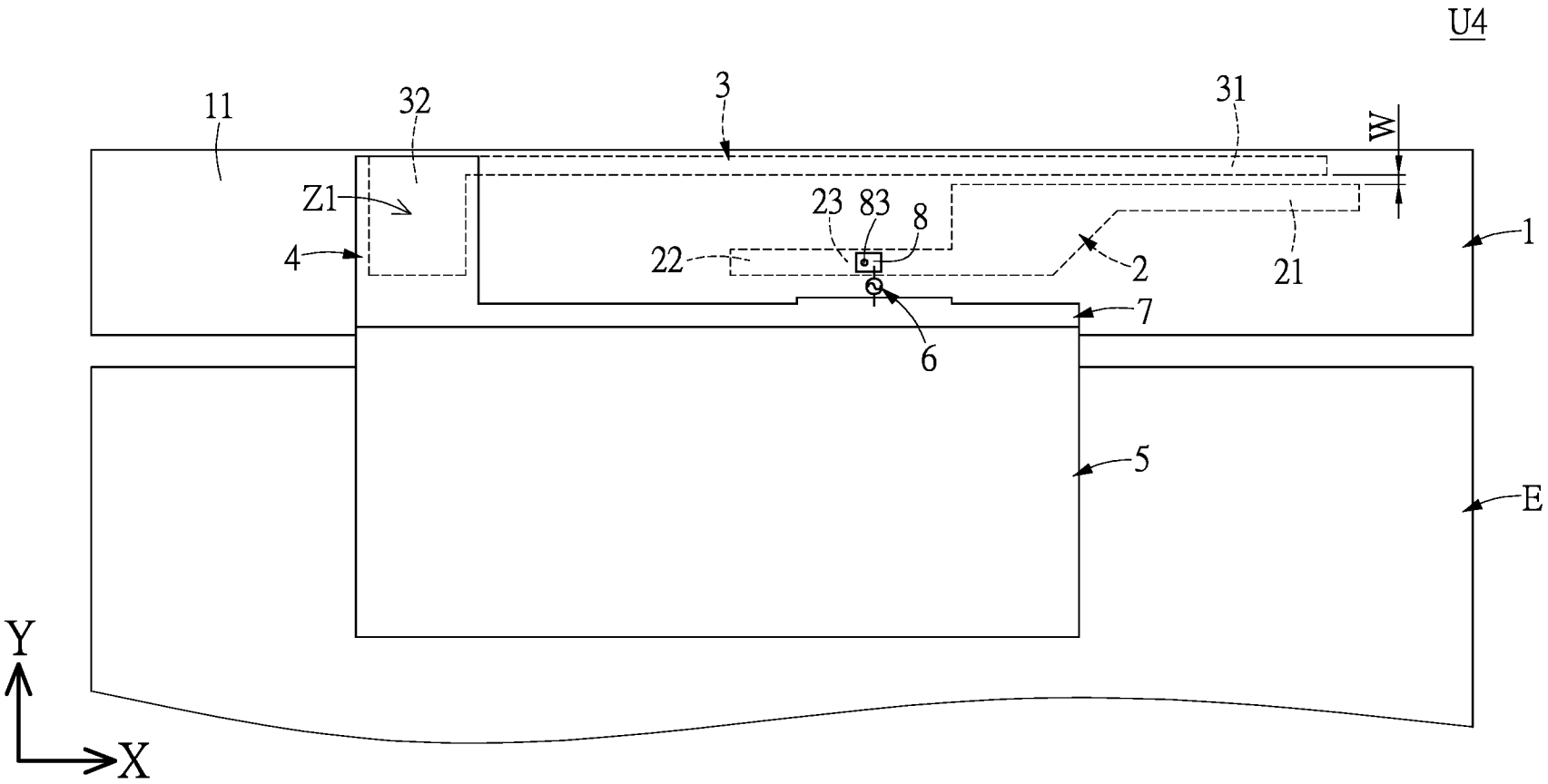
FIG. 7 is a schematic top view of the antenna structure according to the fourth embodiment of the present disclosure.

Reference is next made to FIG. 7, where FIG. 7 is a schematic top view of the antenna structure according to the fourth embodiment of the present disclosure. Comparing FIG. 7 and FIG. 4, it can be seen that one of the differences therebetween is that the antenna structure U4 as provided in the fourth embodiment further includes a connecting element 8. The connecting element 8 can connect with the feeding portion 23, and the feeding element 6 can be coupled with the feeding portion 23 through the connecting element 8. Moreover, in the fourth embodiment, the connecting element 8, the coupling element 4 and the bridging element 7 can be disposed on the first surface 11 of the substrate 1, and the first radiation portion 21, the second radiation portion 22 and the feeding portion 23 of the first radiation element 2 and the second radiation element 3 can be disposed on the second surface 12 of the substrate 1. That is to say, the first radiation element 2 and the third radiation element 3 can be disposed on the second surface 12, and the third radiation portion 31 of the second radiation element 3 and the first radiation portion 21 of the first radiation element 2 has the gap W along a vertical projection direction of the second surface 12.

The connecting element 8 can connect with the feeding portion 23. To be more specific, the connecting element 8 can further include a connecting via 83 connecting between the feeding element 6 and the feeding portion 63, so as to allow the feeding element 6 to connect with the feeding portion 23. That is to say, the feeding element 6 and the connecting element 8 electrically connect with the feeding portion 23 through a conductor (not shown in the figure) in the connecting via 83. Furthermore, the disposing conductor in the connecting via 83 allowing the two elements disposed on the two opposite surfaces to be electrically connected is well known to those having ordinary skill in the art, and thus the relevant details will be omitted for the sake for brevity. It should be noted that, in other implementations, the connecting element 8 can be a part of the connecting via 83, which is to say that the feeding element 6 can connect with the connecting via 83, so as to allow the feeding element 6 to connect with the feeding portion 23.

Comparing the present embodiment with the second embodiment, with the inclusion of the connecting element 8 and the connecting via 83 in the present embodiment, the way that the feeding element 6 feeds a signal is changed. In other words, by using the connecting element 8 and the connecting via 83, the first radiation element 2 and the second radiation element 3 can be selectively disposed on the same surface of the substrate 1. It should be further noted that other structural features or the bandwidth of the operating frequency band in FIG. 7 is similar to that of the previous embodiments, and thus the relevant details will be omitted for the sake of brevity.

The Fifth Embodiment

Figure 8:
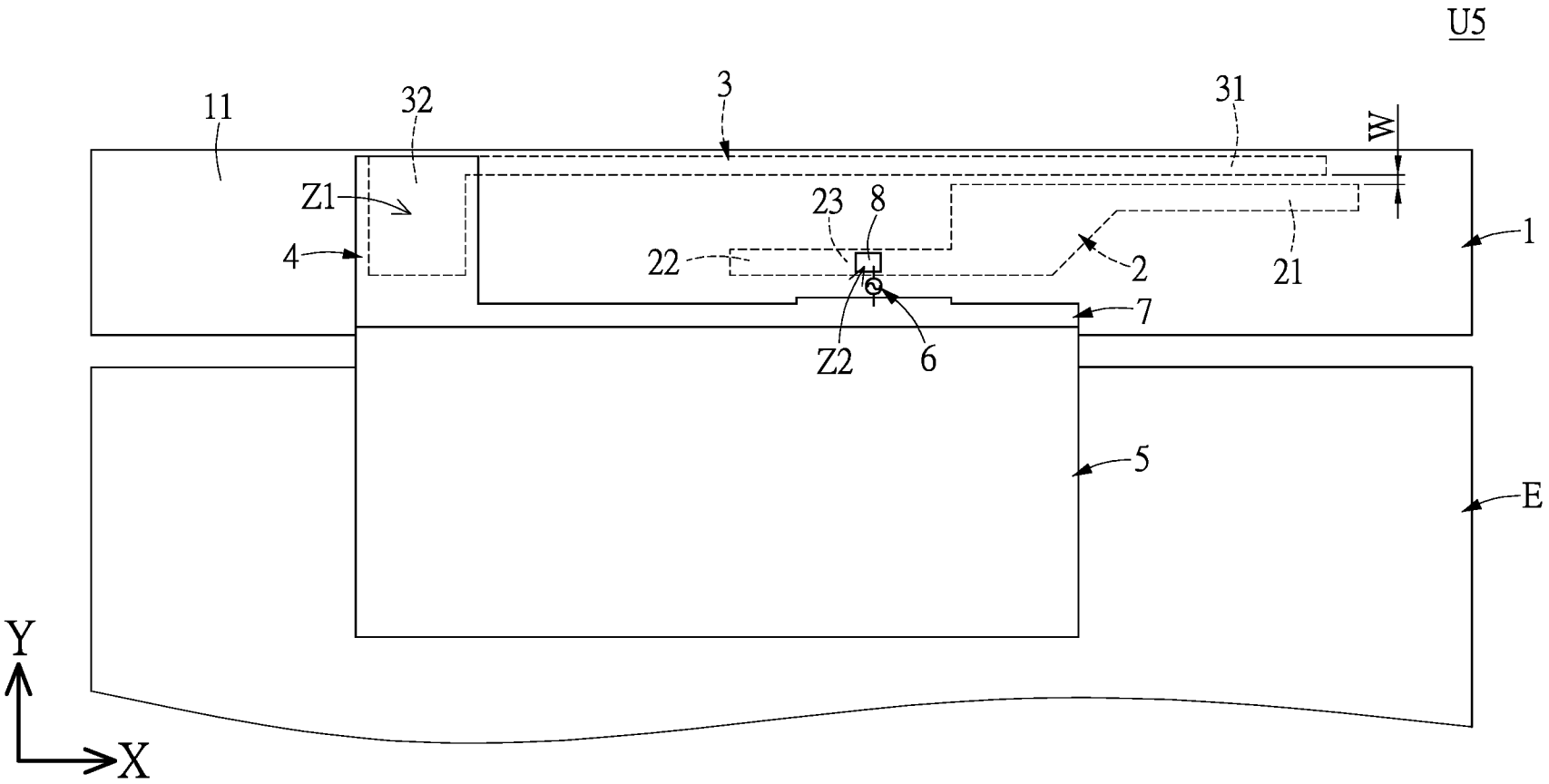
FIG. 8 is a schematic top view of the antenna structure according to a fifth embodiment of the present disclosure.

Reference is next made to FIG. 8, where FIG. 8 is a schematic top view of the antenna structure according to a fifth embodiment of the present disclosure. Comparing FIG. 8 and FIG. 4, it can be seen that one of the differences therebetween is that the antenna structure U5 as provided in the fifth embodiment further includes a connecting element 8. The connecting element 8 can be coupling to the feeding portion 23, and a signal from the feeding element 6 can be coupling to the feeding portion 23 through the connecting element 8. Moreover, in the fifth embodiment, the connecting element 8, the coupling element 4 and the bridging element 7 can be disposed on the first surface 11 of the substrate 1, and the first radiation portion 21, the second radiation portion 22 and the feeding portion 23 of the first radiation element 2 and the second radiation element 3 can be disposed on the second surface 12 of the substrate 1.

The connecting element 8 can be coupling to the feeding portion 23, that is, the connecting element 8 and the feeding portion 23 at least partially overlap with each other along a vertical projection direction of the first surface 11, and the area the connecting element 8 and the feeding portion 23 overlap can be defined as a second coupling area Z2. In other words, comparing the present embodiment with the second and fourth embodiments, the way the feeding element 6 feeds a signal is changed by including the connecting element 8 in the present embodiment. That is to say, a signal from the feeding element 6 is coupling to the feeding portion 23 through the connecting element 8. In other words, by using the connecting element 8, the first radiation element 2 and the second radiation element 3 can be selectively disposed on the same surface of the substrate 1. It should be further noted that other structural features or the frequency range of the operating frequency band in FIG. 8 is similar to that of the previous embodiments, and thus the relevant details will be omitted for the sake of brevity.

The Sixth Embodiment

Figure 9:
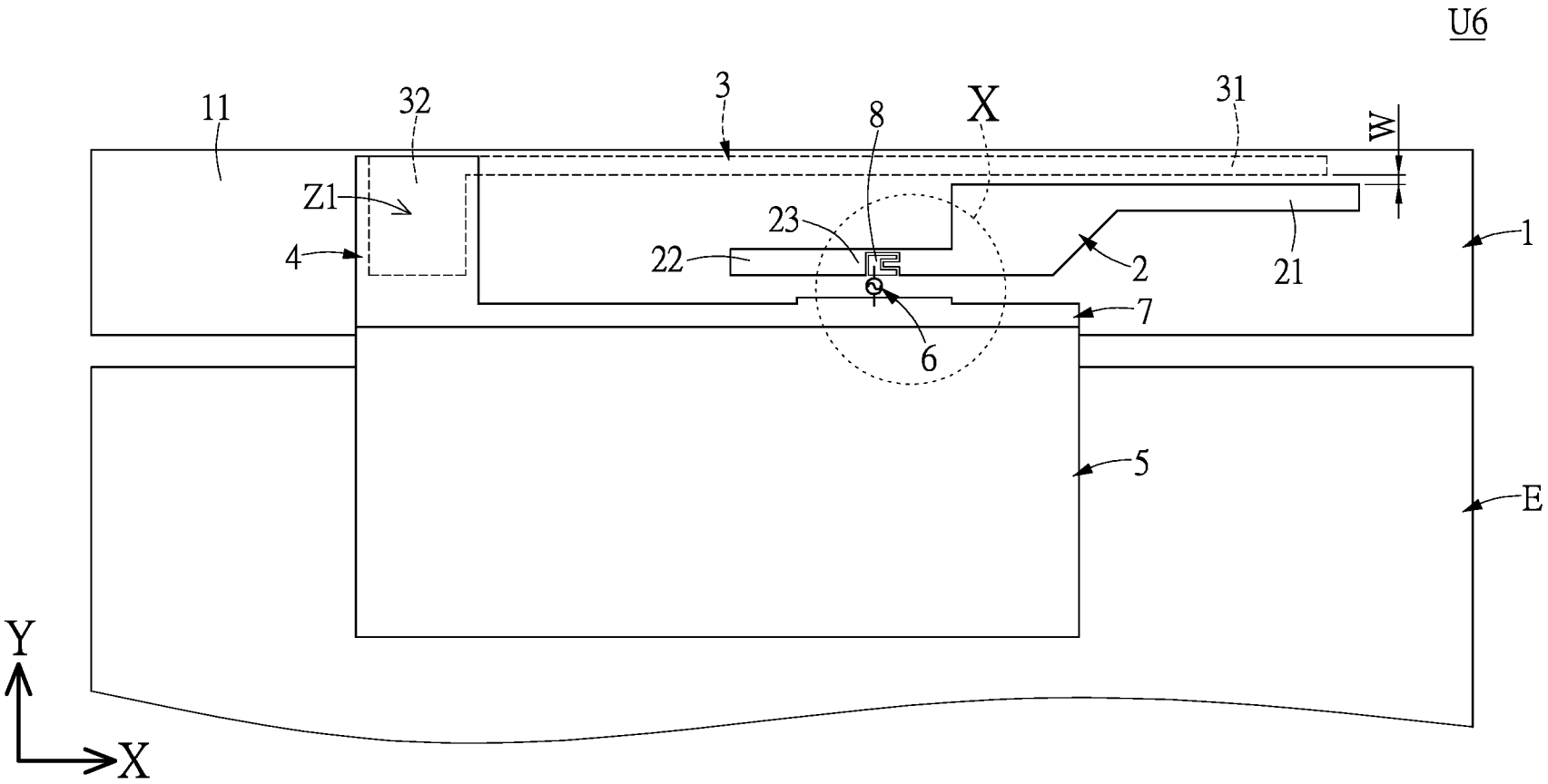
FIG. 9 is a schematic top view of the antenna structure according to a sixth embodiment of the present disclosure.
Figure 10:
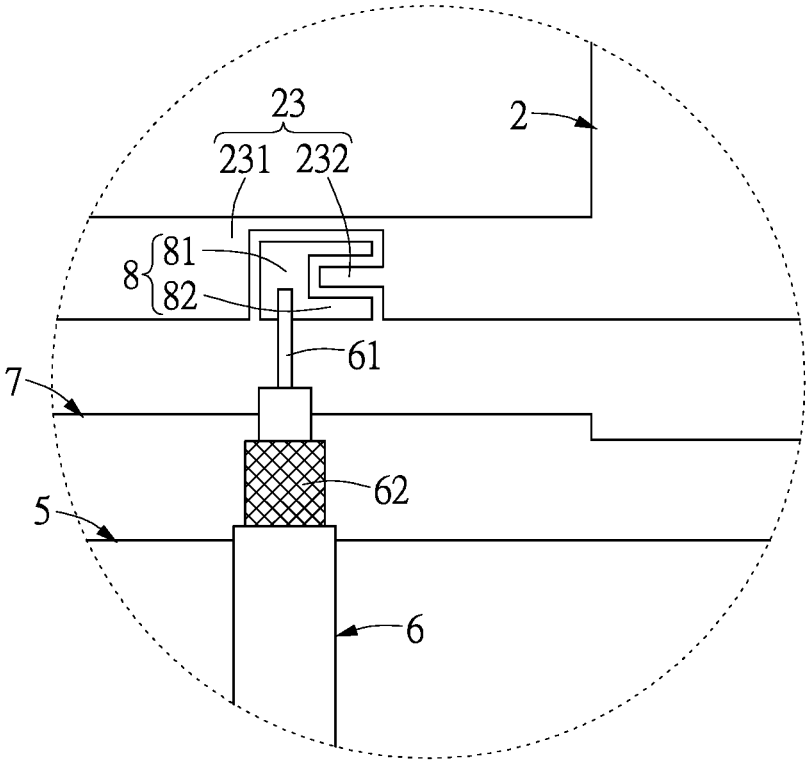
FIG. 10 is a fragmentary enlarged view of section X in FIG. 9.

Reference is next made to FIGS. 9 and 10, where FIG. 9 is a schematic top view of the antenna structure according to a sixth embodiment of the present disclosure and FIG. 10 is a fragmentary enlarged view of section X in FIG. 9. Comparing FIG. 9 and FIG. 4, it can be seen that one of the differences therebetween is that the antenna structure U6 as provided in the sixth embodiment further includes a connecting element 8. The connecting element 8 can be coupling to the feeding portion 23, and the feeding element 6 can be coupling to the feeding portion 23 through the connecting element 8. Moreover, in the sixth embodiment, the connecting element 8, the first radiation portion 21, the second radiation portion 22, the coupling portion 23, the coupling element 4 and the bridging element 7 can be disposed on the first surface 11 of the substrate 1, and the second radiation element 3 can be disposed on the second surface 12 of the substrate 1.

In the sixth embodiment as shown in FIG. 10, the connecting element 8 can be coupling to the feeding portion 23. For example, the connecting element 8 can have a plurality of coupling blocks (the first coupling block 81 and/or the second coupling block 82), the feeding portion 23 can have a plurality of coupling segments (the first coupling segment 231 and/or the second coupling segment 232), the plurality of coupling blocks and the coupling segments are interweavingly configured for mutual coupling and forming a coupling area. In other words, comparing the present embodiment with the second and fourth embodiments, by including the connecting element 8 and the connecting via 83, the way the feeding element 6 feeds a signal is changed. That is to say, a signal from the feeding element 6 is coupling to the feeding portion 23 through the connecting element 8. In other words, by using the connecting element 8, the first radiation element 2 and the second radiation element 3 can be selectively disposed on the same surface of the substrate 1. It should be further noted that other structural features or the frequency range of the operating frequency band in FIG. 9 is similar to that of the previous embodiments, and thus the relevant details will be omitted for the sake of brevity.

The Seventh Embodiment

Figure 11:
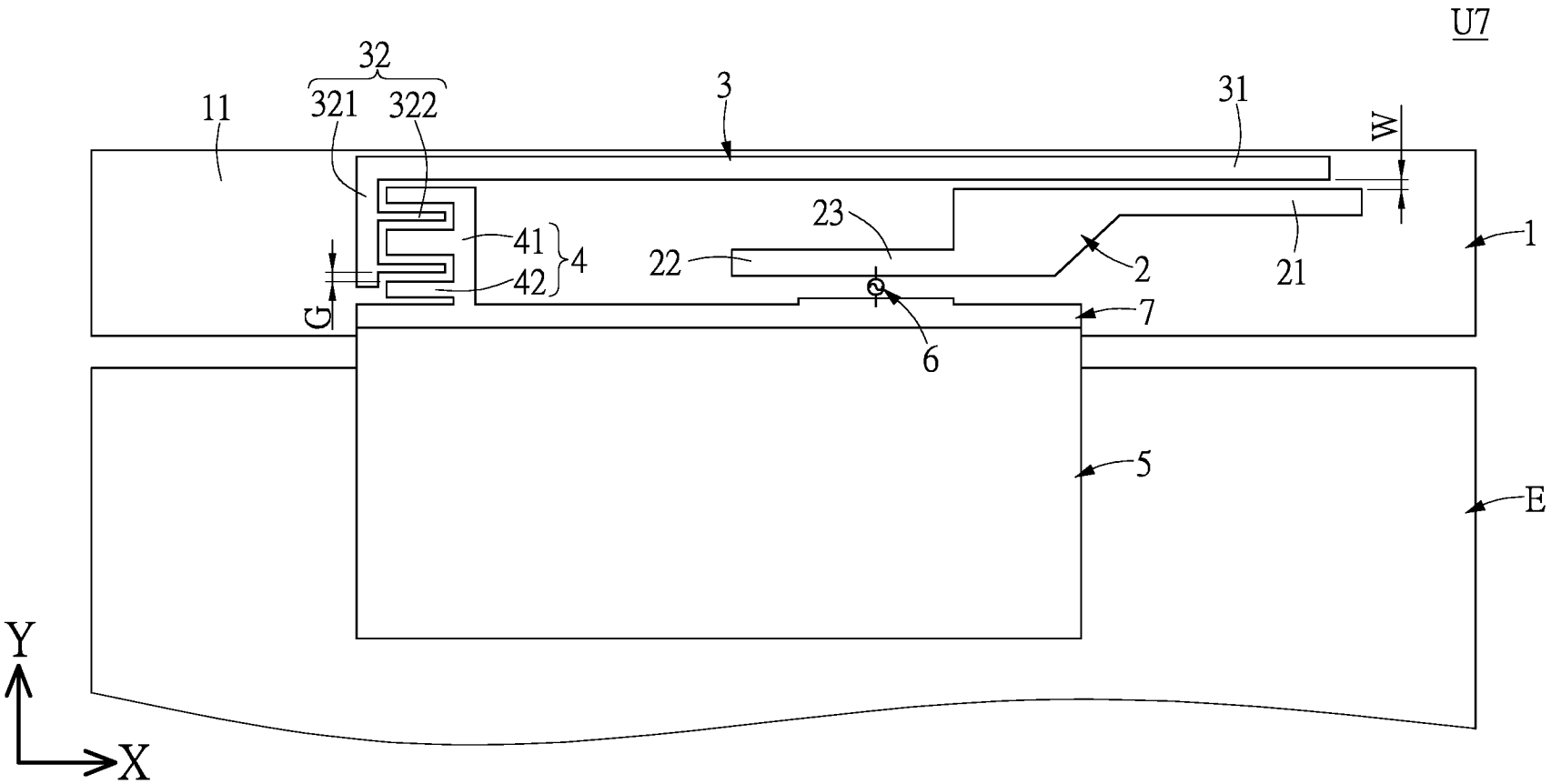
FIG. 11 is a schematic top view of the antenna structure according to a seventh embodiment of the present disclosure.

Reference is next made to FIG. 11, where FIG. 11 is a schematic top view of the antenna structure according to a seventh embodiment of the present disclosure. Comparing FIG. 11 and FIG. 4, it can be seen that one of the differences therebetween is that the first radiation element 2 and the second radiation element 3 of the antenna structure U6 as provided in the seventh embodiment can be disposed on the first surface 11, and the third radiation portion 32 of the second radiation element 3 and the first radiation portion 21 of the first radiation element 2 has the gap W along a vertical projection direction of the first surface 11. In other words, the third radiation portion 31 of the second radiation element 3 and the coupling portion 32 can be disposed on the first surface 11 of the substrate, and the connecting element 8, the first radiation portion 21, the second radiation portion 22, the feeding portion 23, the coupling element 4 and the bridging element 7 can all be disposed on the first surface 11 of the substrate 1.

The coupling element 4 can have a plurality of coupling arms (the first coupling arm 41 and/or the second coupling arm 42), the coupling portion 32 can have a plurality of coupling segments (the first coupling segment 321 and/or the second coupling segment 322), the plurality of coupling arms and segments are interweavingly configured for mutual coupling and forming the first coupling area Z1. The coupling segment and the coupling arm can have at least one or more than one coupling slots G therebetween. It should be noted that the greater the coupling degree (i.e., the coupling amount, which is the length that the coupling segment and the coupling arm is coupling to) between the coupling segment and the coupling arm, the better the impedance matching of the third operating frequency band generated by the antenna structure U7 (the closer to a predetermined impedance value an impedance value that the center frequency of the third operating frequency band corresponds to is). However, when the first coupling area Z1 is greater than a predetermined value, the impedance value that the center frequency of the third operating frequency band corresponds to would stop changing. Moreover, the smaller the coupling degree between the coupling segment and the coupling arm, the worse the impedance matching of the third operating frequency band of the antenna structure U7. In other words, comparing the present embodiment with the second embodiment, the way the coupling element 4 and the coupling portion 32 couple together can be changed in the present embodiment by including the plurality of coupling segments and the plurality of coupling arms. Furthermore, it should be noted that other structural features or the frequency range of the operating frequency band as shown in FIG. 11 is similar to that of the previous embodiment, thus relevant details are omitted for the sake of brevity.

The Eighth Embodiment

Figure 12:
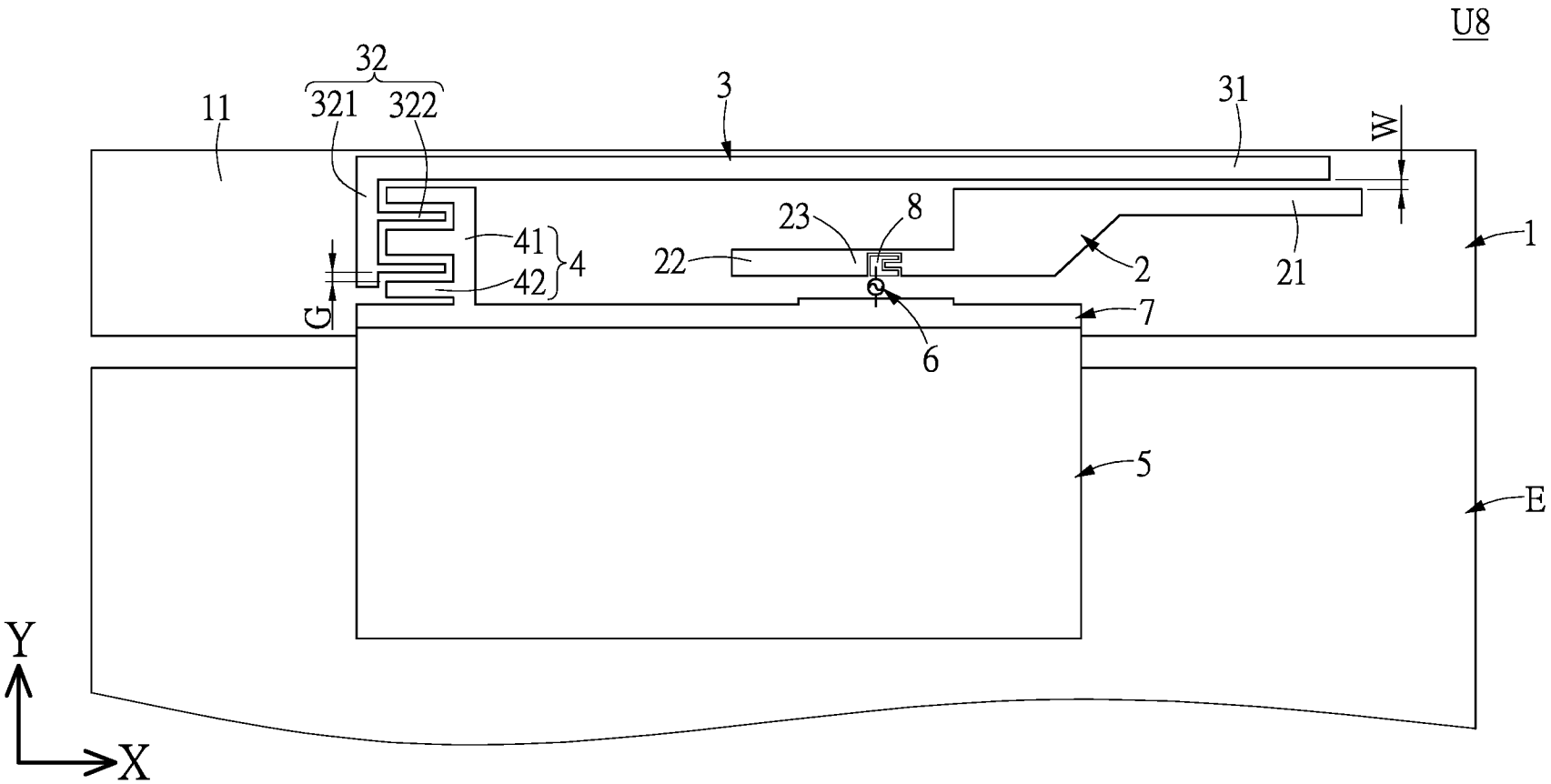
FIG. 12 is a schematic top view of the antenna structure according to an eighth embodiment of the present disclosure.

Reference is next made to FIG. 12, where FIG. 12 is a schematic top view of the antenna structure according to an eighth embodiment of the present disclosure. Comparing FIG. 12 and FIG. 11, it can be seen that one of the differences therebetween is that the antenna structure U8 as provided in the eighth embodiment further includes a connecting element 8. The connecting element 8 can be coupling to the feeding portion 23, and a signal from the feeding element 6 can be coupling to the feeding portion 23 through the connecting element 8. In other words, the way the feeding element 6, the connecting element 8 and the feeding portion 23 connect is the same as that in FIG. 6.

To be more specific, referring to FIGS. 12 and 10, the third radiation portion 31 of the second radiation element 3 and the coupling portion 32 can be disposed on the first surface 11 of the substrate 1, and the connection element 8, the first radiation portion 21, the second portion 22, the feeding portion 23, the coupling element 4 and the bridging element 7 can all be disposed on the first surface 11 of the substrate 1. For example, the connecting element 8 can have a plurality of coupling blocks (the first coupling block 81 and/or the second coupling block 82), and the feeding portion 23 can have a plurality of coupling segments (the first coupling segment 231 and/or the second coupling segment 232). The plurality of coupling blocks and the coupling segments are interweavingly configured so that the connecting element 8 can be coupling to the feeding portion 23 to form a coupling area. That is to say, a signal from the feeding element 6 is coupling to the feeding portion 23 through the connecting element 8. In other words, by using the connecting element 8, the coupling element 4 and the coupling portion 23, the first radiation element 2, the second radiation element 3 and the coupling element 4 can be selectively disposed on the same surface of the substrate 1. It should be further noted that other structural features or the frequency range of the operating frequency band in FIG. 12 is similar to that of the previous embodiments, and thus the relevant details will be omitted for the sake of brevity.

The Ninth Embodiment

Figure 13:
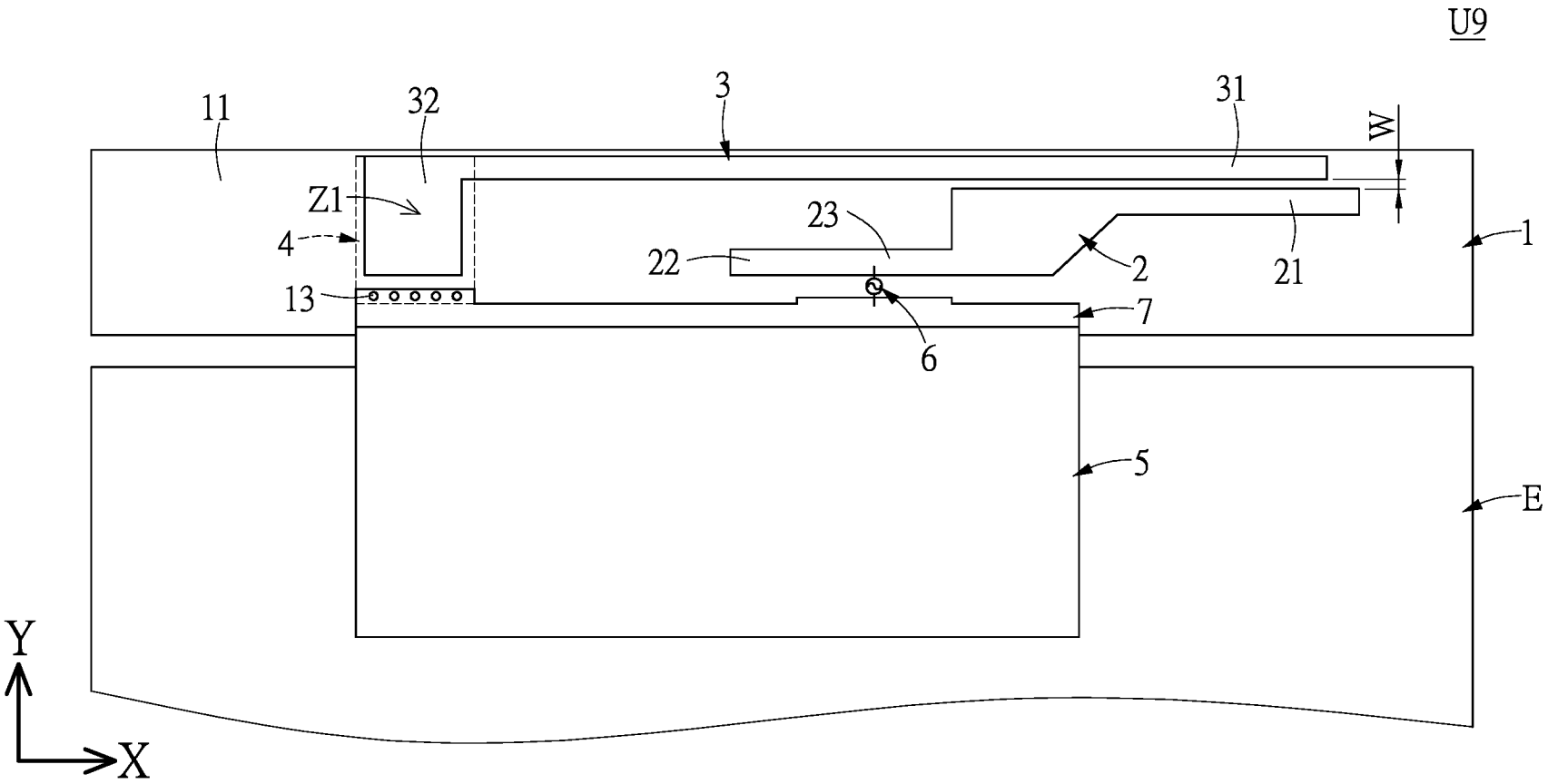
FIG. 13 is a schematic top view of the antenna structure according to a ninth embodiment of the present disclosure.

Reference is next made to FIG. 13, where FIG. 13 is a schematic top view of the antenna structure according to a ninth embodiment of the present disclosure. Comparing FIG. 13 and FIG. 4, it can be seen that one of the differences therebetween is that the antenna structure U9 as provided in the ninth embodiment further includes a grounding via 13, and the grounding via 13 connects between (or is coupled between) the coupling element 4 and the grounding element 5, so as allowing the coupling element 4 to connect with the grounding element 5 through the grounding via 13.

In the present embodiment, the first radiation element 2, the coupling portion 32 of the second radiation element 3, the grounding element 5 and the third radiation portion 31 can be disposed on the first surface 11 of the substrate 1, the coupling element 4 can be disposed on the second surface 12 of the substrate 1, and the coupling element 4 and the coupling portion 32 at least partially overlap with each other along a vertical projection direction of the first surface 11, in which the area that the coupling element 4 and the coupling portion 32 overlap can be defined as a first coupling area Z1. Moreover, the grounding via 13 connects between the coupling element 4 and the grounding element 5, and the coupling element 4 electrically connects with the bridging element 7 through a conductor (not shown in the figure) in the grounding via 13, so as allowing the coupling element 4 to connect with the grounding element 5 through the grounding via 13 and the bridging element 7. In other words, in the present embodiment, the first radiation element 2, the second radiation element 3 and the grounding element 5 can be disposed on the same surface, and only the coupling element 4 is disposed on a different surface. It should be noted that usage of a conductor in the grounding via 13 to make the elements on different surfaces electrically connected is a technique well known in the art, and thus relevant details will be omitted for the sake of brevity. It should be further noted that other structural features or the frequency range of the operating frequency band in FIG. 13 is similar to that of the previous embodiments, and thus the relevant details will also be omitted for the sake of brevity.

The Tenth Embodiment

Figure 14:
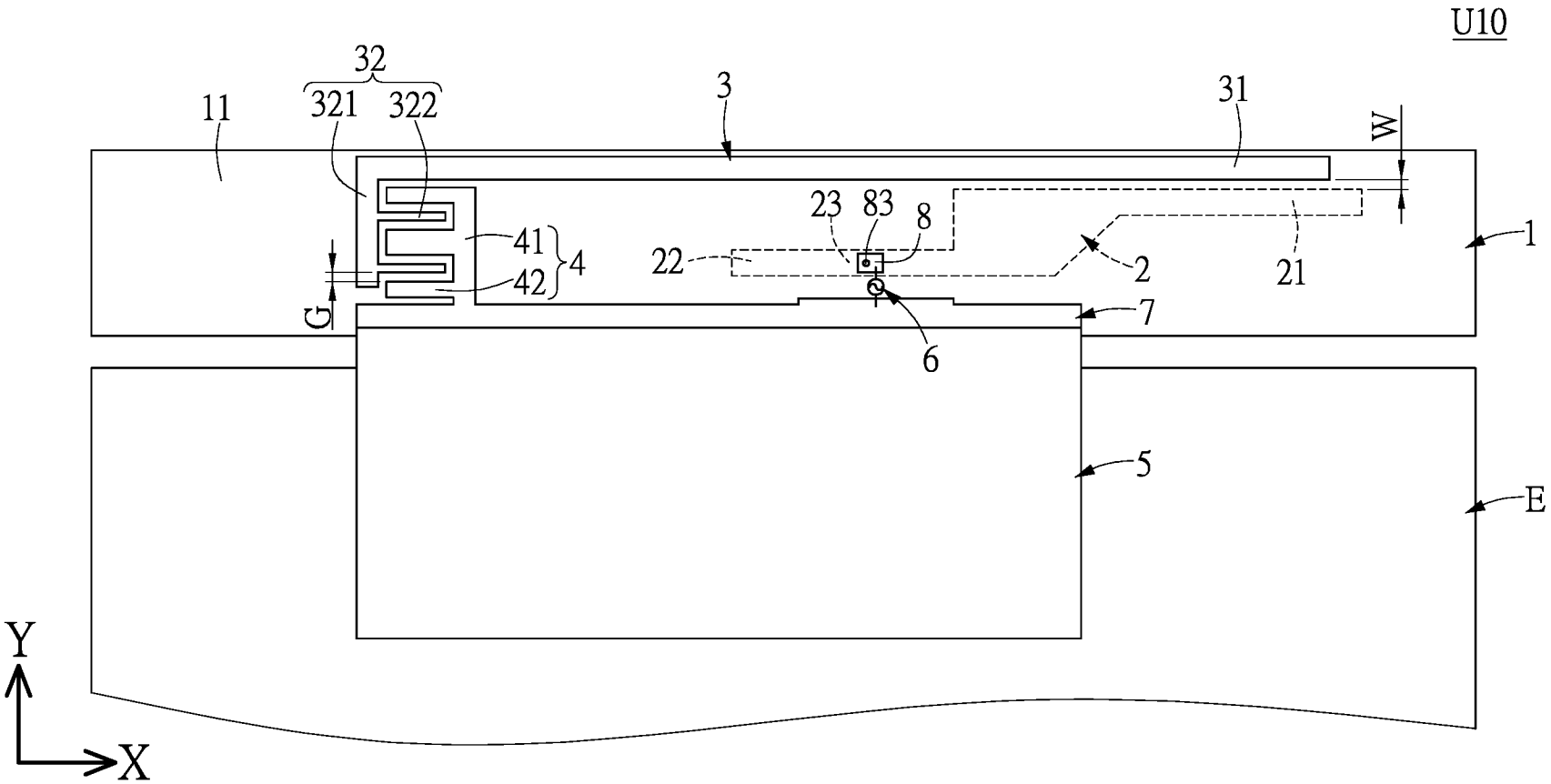
FIG. 14 is a schematic top view of the antenna structure according to a tenth embodiment of the present disclosure.

Reference is next made to FIG. 14, where FIG. 14 is a schematic top view of the antenna structure according to a tenth embodiment of the present disclosure. Comparing FIG. 14 and FIG. 11, it can be seen that one of the differences therebetween is that the antenna structure U10 as provided in the eighth embodiment further includes a connecting element 8, and the connecting element 8 can be disposed on the first surface 11 of the substrate 1. The first radiation portion 21 of the first radiation element 2, the second radiation portion 22 and the feeding portion 23 can be disposed on the second surface 12 of the substrate 1. That is to say, the first radiation element 2 can be disposed on the second surface 12, the second radiation element 3 can be disposed on the first surface 11, and the third radiation portion 31 of the second radiation element 3 and the first radiation portion 21 of the first radiation element 2 have the gap W on a vertical projection direction of the first surface 11.

To be more specific, since the connecting element 8 is disposed on the first surface 11 and the feeding portion 23 is disposed on the second surface 12, the connecting element 8 can be coupled with the feeding portion 23 and the feeding element 6 can be coupled with the feeding portion 23 through the connecting element 8. As shown in FIG. 14 and as addressed in the fourth embodiment, by using the connecting via 83 connected between the connecting element 8 and the feeding portion 23, the connecting element 8 can be coupled with the feeding portion 23. Moreover, it should be noted that in other implementations, the connecting via 83 need not to be formed between the connecting element 8 and the feeding portion 23, such as that disclosed in the fifth embodiment, in which the connecting element 8 is coupling to the feeding portion 23. That is, the connecting element 8 and the feeding portion 23 at least partially overlap with each other along a vertical projection direction of the first surface 11, and the area that the connecting element 8 and the feeding portion 23 overlap can be defined as a second coupling area Z2. A signal from the feeding element 6 can be coupling to the feeding portion 23 through the connecting element 8. It should be further noted that other structural features or the frequency range of the operating frequency band in FIG. 14 is similar to that of the previous embodiments, and thus the relevant details will be omitted for the sake of brevity.

The Eleventh Embodiment

Figure 15:
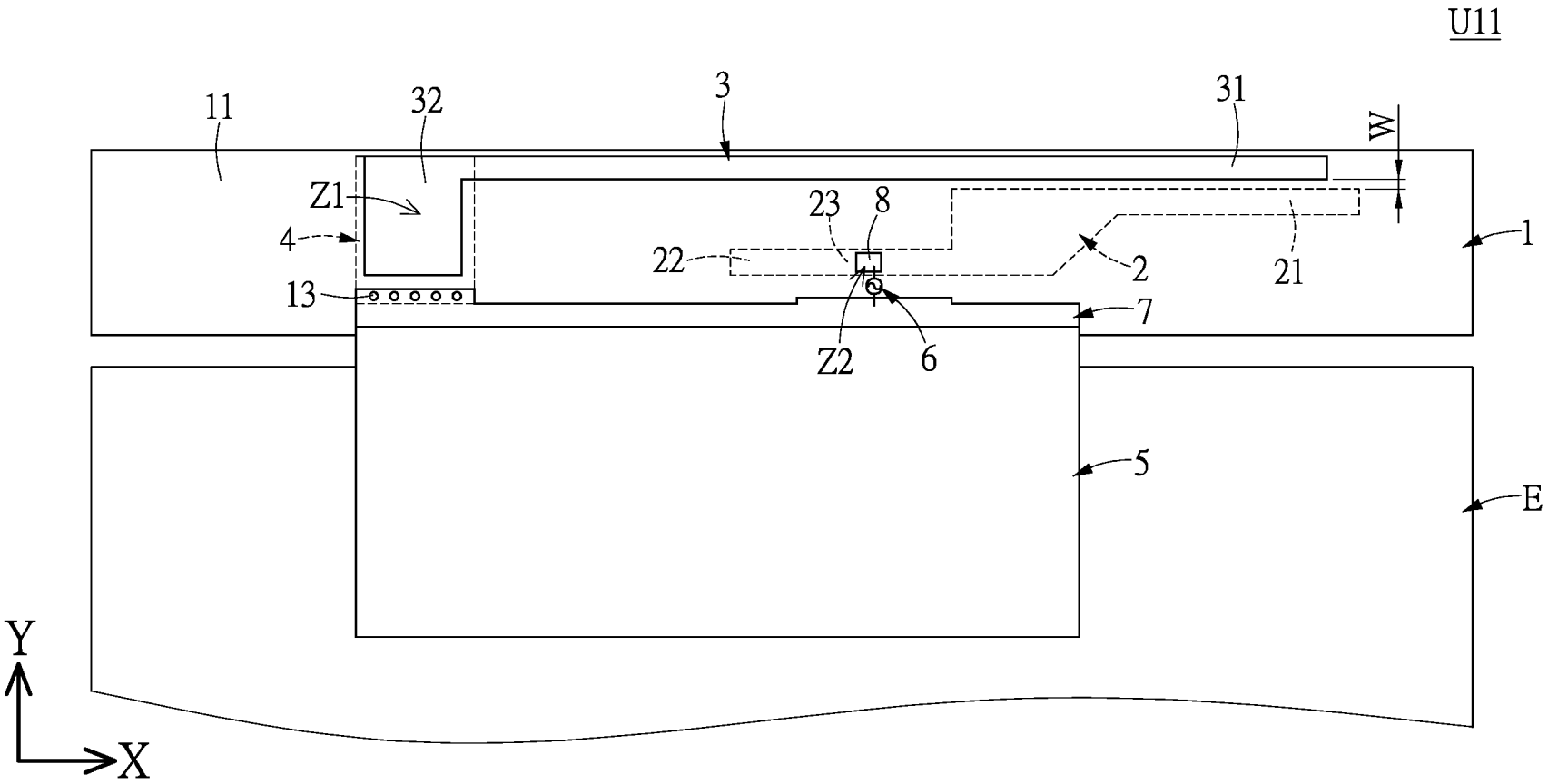
FIG. 15 is a schematic the top view of the antenna structure according to an eleventh embodiment of the present disclosure.

Reference is next made to FIG. 15, where FIG. 15 is a schematic the top view of the antenna structure according to an eleventh embodiment of the present disclosure. In the present embodiment, a signal from the feeding element 6 can be coupling to the feeding portion 23 through the connecting element 8. Comparing FIG. 15 and FIG. 13, it can be seen that one of the differences therebetween is that the antenna structure U11 as provided in the eighth embodiment further includes a connecting element 8. The connecting element 8 of the first radiation element 2 can be disposed on the first surface 11 of the substrate 1, and the first radiation portion 21 of the first radiation element 2, the second radiation portion 22 and the feeding portion 23 can be disposed on the second surface 12 of the substrate 1. The substrate 1 can further include a grounding via 12, and the grounding via 13 connects between the coupling element 4 and the grounding element 5, so as allowing the coupling element 4 to be coupled with the grounding element 5 through the grounding via 13.

Referring to FIGS. 14 and 15, in other implementations, the connecting element 8 can be selectively disposed, so as allowing the connecting element 8 to be coupling to the feeding portion 23 through coupling, or allowing the connecting element 8 to be coupled with the feeding portion 23 through the grounding via 83. Moreover, the coupling element 4 can be selectively disposed on either the first surface 11 or the second surface 12 of the substrate 1. That is to say, when the coupling element 4 and the coupling portion 32 of the second radiation element 3 are disposed on the first surface 11 of the substrate 1, the coupling between the plurality of coupling arms (the first coupling arm 41 and/or the second coupling arm 42) on the coupling element 4 and the plurality of coupling segments (the first coupling segment 321 and/or the second coupling segment 322) on the coupling portion 32 can be used to form the first coupling area Z1. Moreover, when the coupling element 4 is disposed on the second surface 2 of the substrate 1 and the coupling portion 32 of the second radiation element 3 and the grounding element 5 are disposed on the first surface 1, the grounding via 13 connected between the coupling element 4 and the grounding element 5 can be used to make the coupling element 4 be coupled with the grounding element 5 through the grounding via 13.

In other words, the way the feeding element 6 feeds a signal into the feeding portion 23, or the way the coupling element 4 and the coupling portion 32 couple can be selectively configured. Furthermore, it should be noted that other structural features or the frequency range of the operating frequency band as shown in FIG. 15 is similar to that of the previous embodiment, thus relevant details are omitted for the sake of brevity.

The Twelfth Embodiment

Figure 16:
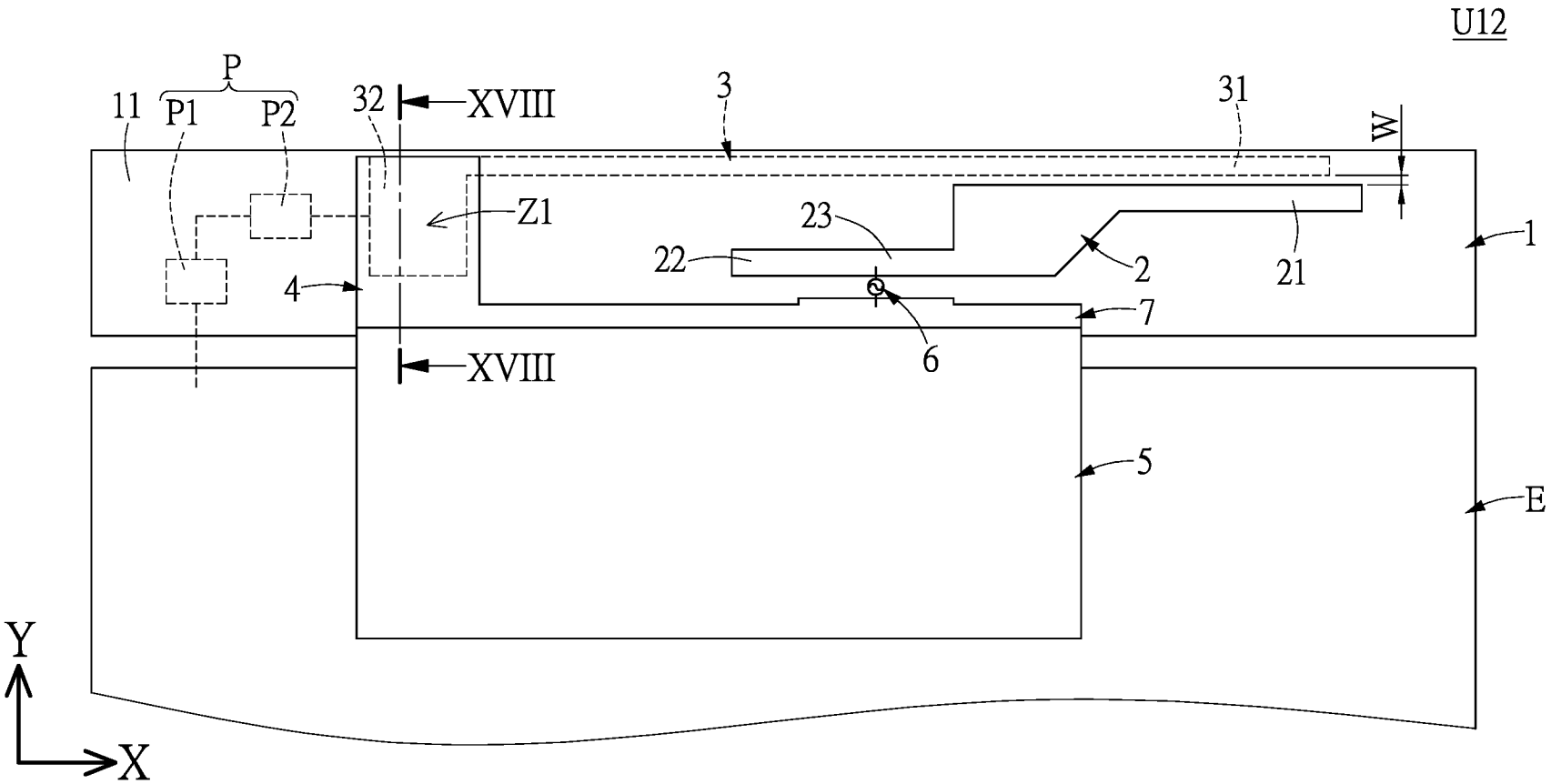
FIG. 16 is a schematic top view of the antenna structure according to a twelfth embodiment of the present disclosure.
Figure 17:
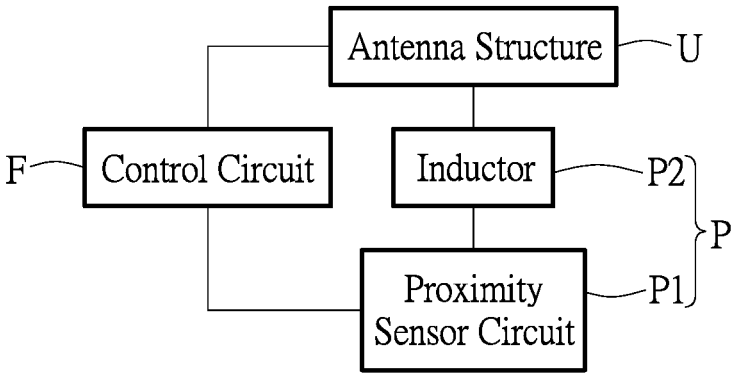
FIG. 17 is a schematic view illustrating a functional block diagram of the antenna structure according to the twelfth embodiment of the present disclosure.
Figure 18:
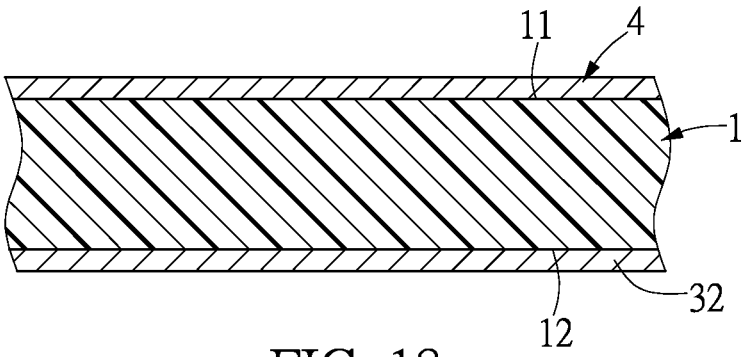
FIG. 18 is a side sectional view taken along line XVIII-XVIII of FIG. 16.

Reference is next made to FIGS. 16-18, where FIG. 16 is a schematic top view of the antenna structure according to a twelfth embodiment of the present disclosure, FIG. 17 is a schematic view illustrating a functional block diagram of the antenna structure according to the twelfth embodiment of the present disclosure and FIG. 18 is a side sectional view taken along line XVIII-XVIII of FIG. 16. Comparing FIG. 16 and FIG. 4, it can be seen that one of the differences therebetween is that the antenna structure U12 of the present embodiment can further include a sensor circuit P being used cooperatively. It should be noted that the antenna structures (i.e., antenna structures U1~U12, abbreviated as antenna structure U in the following, as shown in FIG. 17) in the previous embodiments can also operate with the sensor circuit P. Furthermore, for example, the sensor circuit in the present embodiment can include a sensor circuit P1 and an inductor P2. By the sensor circuit P1 and the inductor P2, the antenna structure U can detect if a human body is approaching, which allows for the transmission power of the antenna structure U to be adjusted. Moreover, the antenna structure U can be applied in, but not limited to, hybrid laptops or 2-in-1 laptops.

Referring to FIGS. 16-18, to more specific, the coupling element 4 can be disposed on the first surface 11 of the substrate 1, the coupling portion 32 of the second radiation element 3 can be disposed on the second surface 12 of the substrate 1. Moreover, the inductor P2 can be coupled with between the coupling portion 32 and the proximity sensor circuit P1, and the proximity sensor circuit P1 can electrically connect between the inductor P2 and the grounding element 5 to form a conductive loop. For example, the inductor P2 can be a low-pass filter, the proximity sensor circuit P1 can be a capacitance sensing circuit, and the coupling portion 32 of the second radiation element 3 of the antenna structure U can function as a sensing electrode for the proximity sensor circuit P1 to measure the capacitance. Moreover, for example, when the antenna structure U is applied in 2-in-1 laptops, the metal conductor E can be, but not limited to, the back case structure of the laptops. It should be noted that even though the proximity sensor circuit P1 indirectly electrically connects with the grounding element 5 through the metal conductor E in the figure, in other embodiments of the present disclosure, the proximity sensor circuit P1 can also be directly electrically connected with the grounding element 5 or other grounding loops.

Referring to FIG. 17, for example, the proximity sensor circuit P1 and the inductor P2 can electrically connect between the antenna structure U and a control circuit F, and the control circuit F electrically connects with the antenna structure U. Therefore, the control circuit F can, according to a signal detected by the proximity sensor circuit P1, adjust the transmission power of the antenna structure U. In other words, the proximity sensor circuit P1 can be configured to detect the parasitic capacitance between the coupling portion 32 of the second radiation element 3 and the metal conductor E, and further to determine the distance between an object (e.g., the legs or other parts of a user) and the proximity sensor circuit P1. It should be noted that the control circuit F can be, but not limited to, integrated in the proximity sensor circuit P1. It should be further noted that the control circuit F is shown in FIG. 16 for ease of illustration.

That is to say, the second radiation element 3 of the antenna structure U can be considered as a sensor electrode or a sensor pad, and the control circuit F can, by the changing in the capacitance detected by the proximity sensor circuit P1, determine if the legs or other parts of a user are close enough to a predetermined detecting range of the antenna structure U. When the legs or other parts of the user are detected to be in the predetermined detecting range, the control circuit F can tune the transmission power of the antenna structure U down to prevent the SAR value from rising too high. When the legs or other parts of the user are detected to be out of the predetermined detecting range, the control circuit F can tune the transmission power of the antenna structure U up to maintain the overall efficiency of the antenna structure U. It should be noted that, the inductor P2 as described in the present embodiment is not the proximity sensor circuit P1. It should be noted that other structural features or the frequency range of the operating frequency band is similar to that of the previous embodiment, thus relevant details are omitted for the sake of brevity. That is to say, FIG. 16 is described based on the configuration shown in FIG. 4; however, in the present embodiment, the first radiation element 2, the configuration of the second radiation element 3 and the coupling element 4 can also be selectively disposed, and the present disclosure should not be limited thereto.

Figure 19:
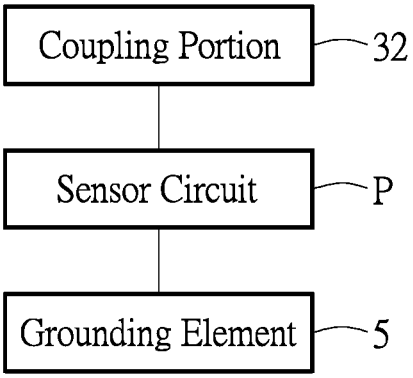
FIG. 19 is a schematic view illustrating another functional block diagram of the antenna structure according to the twelfth embodiment of the present disclosure.
Figure 20:
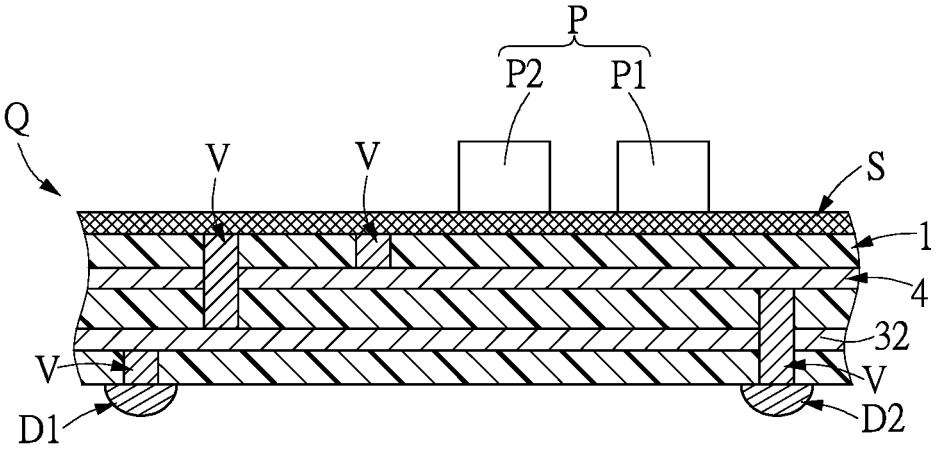
FIG. 20 is another side sectional view of the antenna structure according to the twelfth embodiment of the present disclosure.
Figure 21:
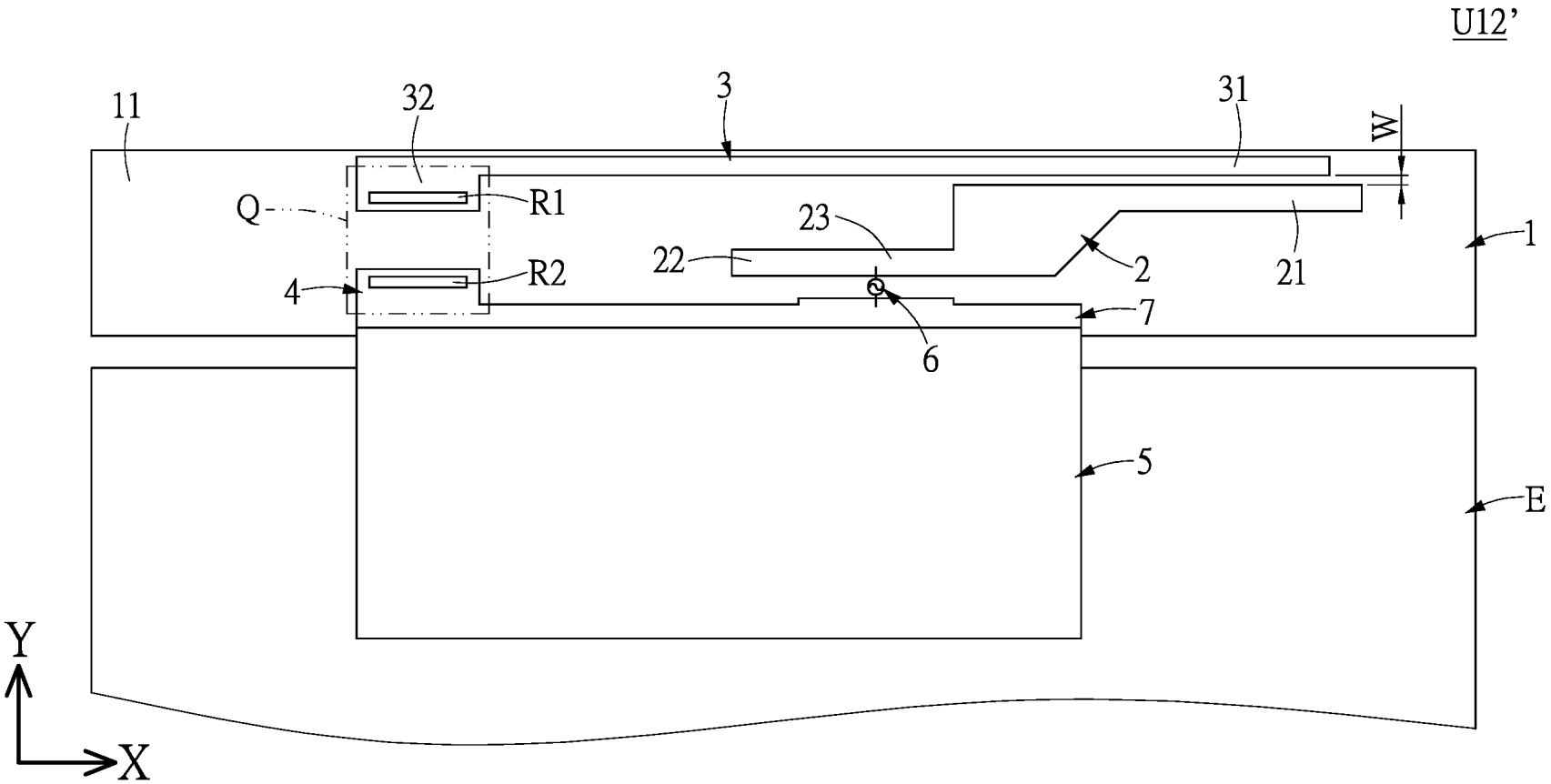
FIG. 21 is another schematic top view of the antenna structure according to the twelfth embodiment of the present disclosure.

Reference is next made to FIGS. 19-21, in other embodiments, the antenna structure U12' can further include a system in package component Q. The coupling portion 32, the coupling element 4 and the sensing circuit P can be integrated by System in Package (SiP) to form the system in package component Q. In other words, the system in package component Q can have the coupling portion 32, the coupling element 4 and the sensing circuit P. According to the present embodiment, the system in package component Q can has a multi-layer metal layer, for example, the system in package component Q can be a multi-layer structure. In one embodiment, the system in package component Q has, but not limited to, four metal layers and three substrate layers.

Moreover, reference is made to FIGS. 20-21 collectively. The coupling portion 32 of the second radiation element 3 can be disposed in the system in package component Q, and the sensing circuit P can be disposed on the system in package component Q, so as to allow the sensing circuit P to be coupled with the coupling portion 32 and the grounding element 5. For example, a first metal layer of the multi-layer metal layer of the system in package component Q can serve as a coupling portion 32 of the second radiation element 3, a second metal layer of the multi-layer metal layer of the system in package component Q can serve as a coupling element 4, and the sensing circuit P can be disposed on a third metal layer (i.e., the wire layer S) of the multi-layer metal layer. That is to say, the sensing circuit P and the inductor P2 can be disposed on the wire layer S of the system in package component Q. Moreover, the coupling element 4 can be coupled with the grounding element 5, a fourth metal layer of the system in package component Q can serve as a bottom metal layer which has solders (D1, D2) for electrical connection with the grounding element 4 and the second radiation element 3.

Furthermore, the sensing circuit P electrically connects between the coupling portion 32 and the coupling element 4 through the connection hole V, and in the meantime, electrically connects with the grounding element 5 through the coupling element 4. Moreover, the coupling portion 32 can electrically connect with the solder D1 through the connection hole V, and the solder D1 can electrically connect with a joint area R1 of the second radiation element 3. The coupling element 4 can electrically connect with the solder D2 through the connection hole V, and the solder D2 can electrically connect with a joint area R2 of the bridging element 7. Therefore, by the system in package component Q, the area of the antenna structure U12' can be decreased. It should be noted that, in other implementations, system packaging can also be utilized to selectively dispose the first radiation element 2, the second radiation element 3 and the coupling element 4, and since the configuration is similar to that of the previous embodiments, relevant details will be omitted for the sake of brevity.

Effects of the Embodiments

One of the effects is that, the antenna structure U (antenna structures U1, U2, U3, U4, U5, U6, U7, U8, U9, U10, U11, U12, U12') as provided in the embodiments of the present disclosure not only increase the antenna efficiencies, but also prevent the SAR value from rising too high when a user is approaching. It should be noted that, in the antenna structure U as addressed in the previous embodiments, the way the first radiation element 2, the second radiation element 3, the bridging element 7, the coupling element 4 and the feeding element 6 are configured can be applied in different embodiments, thereby adjusting the antenna characteristics.

The description illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. An antenna structure, comprising:

a substrate;

a first radiation element disposed on the substrate, including a first radiation portion, a second radiation portion, and a feeding portion connected between the first radiation portion and the second radiation portion;

a second radiation element disposed on the substrate, including a third radiation portion and a coupling portion connected with the third radiation portion, wherein the second radiation element and the first radiation element are separate from each other, the third radiation portion of the second radiation element and the first radiation portion of the first radiation element are separate from each other, and a gap is formed between the third radiation portion and the first radiation portion;

a coupling element disposed on the substrate, the coupling element being separated from the coupling portion and coupling to the coupling portion;

a grounding element coupled with the coupling element, wherein the grounding element and the second radiation element are separate from each other; and a feeding element coupled between the feeding portion and the grounding element;

wherein the first radiation portion extends toward a first direction and the second radiation portion extends toward a second direction.

2. The antenna structure according to claim 1, further comprising a connecting element, wherein the substrate includes a first surface and a second surface opposite to the first surface, the connecting element is coupling to or connected with the feeding portion, and the feeding element is coupling to or coupled with the feeding portion through the connecting element.

3. The antenna structure according to claim 2, wherein the connecting element is disposed on the first surface, the first radiation portion, the second radiation portion and the feeding portion of the first radiation element are disposed on the second surface, and the connection element and the feeding portion at least partially overlap with each other along a vertical projection direction of the first surface.

4. The antenna structure according to claim 3, wherein the coupling element is disposed on the first surface, the coupling portion of the second radiation element is disposed on the second surface, and the coupling element and the coupling portion at least partially overlap with each other along a vertical projection direction of the first surface.

5. The antenna structure according to claim 3, wherein the coupling element and the coupling portion of the second radiation element are disposed on the first surface, the coupling element has a plurality of coupling arms, the coupling portion has a plurality of coupling segments, and the plurality of coupling arms and segments are interweavingly arranged.

6. The antenna structure according to claim 3, wherein the coupling portion of the second radiation element and the grounding element are disposed on the first surface, the coupling element is disposed on the second surface, and the coupling element and the coupling portion at least partially overlap with each other along a vertical projection direction of the first surface, wherein the substrate includes a grounding via connecting between the coupling element and the grounding element, so as to allow the coupling element to connect with the grounding element through the grounding via.

7. The antenna structure according to claim 2, wherein the connecting element, the first radiation portion, the second radiation portion and the feeding portion are disposed on the first surface.

8. The antenna structure according to claim 7, wherein the coupling element is disposed on the first surface, the coupling portion of the second radiation element is disposed on the second surface, and the coupling element and the coupling portion at least partially overlap with each other along a vertical projection direction of the first surface.

9. The antenna structure according to claim 7, wherein the coupling element and the coupling portion of the second radiation element are disposed on the first surface, the coupling element has a plurality of coupling arms, the coupling portion has a plurality of coupling segments, and the plurality of coupling arms and segments are interweavingly arranged.

10. The antenna structure according to claim 7, wherein the coupling portion of the second radiation element and the grounding element are disposed on the first surface, the coupling element is disposed on the second surface, and the coupling element and the coupling portion at least partially overlap with each other along a vertical projection direction of the first surface, wherein the substrate includes a grounding via connecting between the coupling element and the grounding element, so as to allow the coupling element to connect with the grounding element through the grounding via.

11. The antenna structure according to claim 1, wherein the substrate includes a first surface and a second surface opposite to the first surface, the coupling element is disposed on the first surface, the coupling portion of the second radiation element is disposed on the second surface, and the coupling element and the coupling portion at least partially overlap with each other along a vertical projection direction of the first surface.

12. The antenna structure according to claim 1, wherein the substrate includes a first surface and a second surface opposite to the first surface, the coupling element and the coupling portion of the second radiation element are disposed on the first surface, the coupling element has a plurality coupling arms, the coupling portion has a plurality of coupling segments, and the plurality of coupling arms and segments are interweavingly arranged.

13. The antenna structure according to claim 1, wherein the substrate includes a first surface and a second surface opposite to the first surface, the coupling portion of the second radiation element and the grounding element are disposed on the first surface, the coupling element is disposed on the second surface, and the coupling element and the coupling portion at least partially overlap with each other along a vertical projection direction of the first surface, wherein the substrate includes a grounding via connecting between the coupling element and the grounding element, so as to allow the coupling element to connect with the grounding element through the grounding via.

14. The antenna structure according to claim 1, wherein the substrate includes a first surface and a second surface opposite to the first surface, the first radiation element is disposed on the first surface, the second radiation element is disposed on the second surface, and the third radiation portion of the second radiation element and the first radiation portion of the first radiation element have the gap along a vertical projection direction of the first surface.

15. The antenna structure according to claim 1, wherein the substrate includes a first surface and a second surface opposite to the first surface, the first radiation element and the second radiation element are disposed on the first surface, and the third radiation portion of the second radiation element and the first radiation portion of the first radiation element have the gap along a vertical projection direction of the first surface.

16. The antenna structure according to claim 1, further comprising a bridging element disposed on the substrate, wherein the bridging element connects between the coupling element and the grounding element, and the feeding element is coupled with the grounding element through the bridging element.

17. The antenna structure according to claim 1, further comprising a sensor circuit, the sensor circuit including a proximity sensor circuit and an inductor connecting between the coupling portion and the proximity sensing circuit, wherein the coupling portion serves as a sensing electrode for the proximity sensor circuit to measure a capacitance.

18. The antenna structure according to claim 1, wherein a first operating frequency band is generated by the first radiation portion, a second operating frequency band is generated by the second radiation portion, and a third operating frequency band is generated by a resonation between the third radiation portion and the first radiation portion.

19. An antenna structure, comprising:

a substrate;

a first radiation element disposed on the substrate, including a first radiation portion, a second radiation portion, and a feeding portion connected between the first radiation portion and the second radiation portion;

a second radiation element disposed on the substrate, including a third radiation portion, wherein a gap is formed between the third radiation portion and the first radiation portion;

a system in package (SIP) component disposed on the substrate, having a multi-layer metal layer, a first metal layer of the multi-layer metal layer serving as a coupling portion and a second metal layer of the multi-layer metal layer serving as a coupling element, wherein the SIP component has a sensing circuit disposed on a third metal layer of the multi-layer metal layer, wherein the coupling portion connects with third radiation portion, and the coupling element and the coupling portion are separate from and coupling to each other, wherein the sensing circuit includes a proximity sensing circuit and an inductor connecting with the coupling portion, wherein the coupling portion serves as a sensing electrode for the proximity sensor circuit to measure a capacitance;

a grounding element coupled with the coupling element, and the sensing circuit electrically connected with the grounding element through the coupling element;

a feeding element coupled between the feeding portion and the grounding element.

20. An antenna structure, comprising:

a substrate;

a first radiation element disposed on the substrate, including a first radiation portion, a second radiation portion, and a feeding portion connected between the first radiation portion and the second radiation portion;

a second radiation element disposed on the substrate, including a third radiation portion and a coupling portion connected with the third radiation portion, wherein the second radiation element and the first radiation element are separate from each other, the third radiation portion of the second radiation element and the first radiation portion of the first radiation element are separate from each other, and a gap is formed between the third radiation portion and the first radiation portion;

a coupling element disposed on the substrate, the coupling element being separated from the coupling portion and coupling to the coupling portion;

a grounding element coupled with the coupling element, wherein the grounding element and the second radiation element are separate from each other; and a feeding element coupled between the feeding portion and the grounding element;

wherein a first operating frequency band is generated by the first radiation portion, a second operating frequency band is generated by the second radiation portion, and a third operating frequency band is generated by a resonation between the third radiation portion and the first radiation portion.

* * * * *